United States Patent [19]

Koike et al.

[11] Patent Number: 5,076,866

[45] Date of Patent: Dec. 31, 1991

[54] HEAT RESISTANT SLIDE MEMBER FOR INTERNAL COMBUSTION ENGINE

[75] Inventors: Seiichi Koike; Tomoyoshi Matsuno; Hiroyuki Horimura; Masao Ichikawa; Noriaki Matsumoto; Kazunori Fukizawa, all of Saitama, Japan

[73] Assignee: Honda Giken Kogyo Kabushiki Kaisha, Tokyo, Japan

[21] Appl. No.: 482,299

[22] Filed: Feb. 20, 1990

[30] Foreign Application Priority Data

Feb. 17, 1989 [JP] Japan ..... 1-37939
Feb. 17, 1989 [JP] Japan ..... 1-37940

[51] Int. Cl.[5] ..... C22C 21/00; F01L 3/00

[52] U.S. Cl. ..... 148/437; 29/888.44; 29/888.452; 123/188 AA; 123/188 S; 148/415; 428/924; 428/937

[58] Field of Search ..... 148/415, 418, 437; 420/551; 29/888.44, 888.45, 888.452, 888.453, 888.46, 888.072, 88.073; 251/332, 356, 368; 123/188 S, 188 AA

[56] References Cited

U.S. PATENT DOCUMENTS

| | | | |
|---|---|---|---|
| 2,002,641 | 5/1935 | McBride | 29/888.452 |
| 3,362,057 | 1/1968 | Kubera et al. | 29/888.44 |
| 4,347,076 | 8/1982 | Ray et al. | 75/255 |
| 5,022,918 | 6/1991 | Koike et al. | 75/229 |

FOREIGN PATENT DOCUMENTS

| | | |
|---|---|---|
| 105595 | 4/1984 | European Pat. Off. . |
| 1300752 | 12/1972 | United Kingdom . |
| 2179369 | 3/1987 | United Kingdom . |

*Primary Examiner*—R. Dean
*Assistant Examiner*—Robert R. Koehler
*Attorney, Agent, or Firm*—Lyon & Lyon

[57] ABSTRACT

A heat resistant slide member for an internal combustion engine is a plastically worked member formed from a quenched and solidified aluminum alloy, with a metal flow line in a sliding portion thereof set in a sliding direction. The aluminum alloy contains at least one selected from the group consisting of Cr, Fe, Zr and Ti in an amount of 5% or more and 30% by weight or less and has an average diameter of precipitates and crystallizates therein of 50 μm or less and a tensile strength at 300° C. of 18 kg/mm$^2$ or more.

28 Claims, 18 Drawing Sheets

HEAT RESISTANT SLIDE MEMBER FOR INTERNAL COMBUSTION ENGINE

BACKGROUND OF THE INVENTION

1. Field of the Invention

The field of the present invention is improvements of heat resistant slide members for internal combustion engines, such as an intake valve and a piston ring.

2. Description of the Prior Art

Such conventional piston rings have been formed from an iron-based material such as a cast iron, a spring steel, a stainless steel, etc., (see "Piston Ring" issued from Nikkan Kogyo Newspaper Co., Ltd., for example).

Recently, the internal combustion engines are being designed for increased rotation speed and output power and correspondingly, a reduction in weight is required for the piston ring.

Examples of materials having a specific gravity lower than the above-described iron-based material are aluminum alloys. In the existing circumstances, however, the aluminum alloy has a lower high-temperature strength and hence, if a piston ring is formed from the aluminum alloy, the tensile strength of the piston ring will be substantially reduced at a high temperature, e.g., 200° to 300° C. during operation of the engine, resulting in problems of increases in amounts of gas blown-by and oil consumed.

In addition, the intake valve has been formed from a heat resistant steel such as JIS SUH11 or the like.

Likewise, there is also a need for a reduction in weight for the intake valve. However, when a heat resistant steel is used as a material for forming the intake valve as in the prior art, there is a limit to the reduction in weight of the intake valve.

SUMMARY OF THE INVENTION

It is therefore an object of the present invention to provide a slide member of the type described above which is capable of meeting the need for a reduction in weight.

It is another object of the present invention to provide a slide member of the type described above which has an excellent sliding characteristic.

It is a further object of the present invention to provide a slide member of the type described above which has an excellent high-temperature strength.

It is a yet further object of the present invention to provide a slide member of the type described above which is made using a material having a good plastic-workability such as a hot-extrudability.

To achieve the above objects, according to the present invention, there is provided a heat resistant slide member for an internal combustion engine, which is a plastically worked member formed from a quenched and solidified aluminum alloy containing at least one selected from the group consisting of Cr, Fe, Zr and Ti in an amount of 5% or more and 30% or less by weight, and having an average diameter of precipitates and crystallizates therein of 50 μm or less and a tensile strength at 300° C. of 18 kg/mm$^2$ or more, wherein a metal flow line in a sliding portion of the worked member is set in a sliding direction thereof.

With such a construction, it is possible to provide a slide member which is light-weight and has an excellent high-temperature strength and a good productivity by a hot extrusion or the like. Further, because the metal flow line in the sliding portion is set in the sliding direction, the wear resistance can be improved, and wearing of the mating member can be suppressed.

However, if the content of the chemical constituent is less than 5% by weight, no high-temperature strength improving effect is obtained. On the other hand, any content exceeding 30% by weight will cause disadvantages of a reduction in such effect, a reduction in elongation, a degradation in workability and an increase in notch sensitivity, attendant with a reduced durability, an increased manufacture cost and the like.

It is desirable that the average diameter of the precipitates and crystallizates is of 50 μm or less in a valve stem of the intake valve, but of 10 μm or less in the piston ring. In the piston ring, if the average diameter is more than 10 μm, the high-temperature strength is reduced, attendant with a declined tension, resulting in an increased amount of gas blown-by and an increased amount of oil consumed.

Further, it is desirable that the tensile strength at 300° C. is of 18 kg/mm$^2$ with the intake valve, but of 20 kg/mm$^2$ with the piston ring. With the piston ring, if the tensile strength is less than 20 kg/mm$^2$, the high-temperature strength is like wise reduced, attendant with a declined tension to bring about similar disadvantages.

In addition, according to the present invention, there is provided a heat resistant slide member for an internal combustion engine, wherein the quenched and solidified aluminum alloy contains Cr, Fe and Zr in amounts of $4 \leqq Cr \leqq 10\%$ by weight, $0.5 \leqq Fe \leqq 4\%$ by weight and $0.5 \leqq Zr \leqq 3\%$ by weight and the balance of Al including unavoidable impurities.

With such a construction, it is possible to provide a reduction in weight of the slide member and assure a high-temperature strength and further to improve the plastic-workability, particularly the hot-extrudability in the course of the production of the slide member.

Among the added elements, Cr is one element having the smallest coefficient of diffusion into Al and contributes to the precipitation and crystallization of fine intermetallic compounds to provide increases in high-temperature strength and wear resistance of a resultant slide member. However, if the amount of Cr added is less than 4% by weight, such precipitation and crystallization will not be sufficiently produced, resulting in unsatisfactory high-temperature strength and wear resistance. On the other hand, if the amount of Cr added is more than 10% by weight, the elogation of the aluminum alloy may be smaller, resulting in a reduced hot-extrudability and also in a reduced toughness.

Fe is useful to improve the ambient-temperature and high-temperature strengths and Young's modulus of the resultant slide member. However, if the amount of Fe added is less than 0.5% by weight, the effect of addition of Fe may be smaller. On the other hand, if the amount of Fe added is more than 4% by weight, the notch sensitivity is higher and the elongation is smaller.

Zr has effects of improving the extendability of the aluminum alloy and providing an improvement in creep characteristic of the resulting slide member, while at the same time increasing the high-temperature strength by aging.

However, if the amount of Zr added is less than 0.5% by weight, such effects is smaller, whereas if the amount is more than 3% by weight, the extendability is reduced.

Further, according to the present invention, there is provided a heat resistant slide member for an internal combustion engine, wherein the slide member includes a high-temperature exposed portion requiring a heat resistance and a sliding portion connected to the high-temperature exposed portion, and wherein the average diameter of the precipitates and crystallizates in the quenched and solidified aluminum alloy forming the high-temperature exposed portion is less than 5 μm, and the average diameter of the precipitates and crystallizates in the quenched and solidified aluminum alloy forming the sliding portion is of 5 μm or more and 50 μm or less.

The above construction provides an increased heat resistance of the high-temperature exposed portion and an increased wear resistance of the slide member.

However, if the average diameter of the precipitates and crystallizates in the high-temperature exposed portion is more than 5 μm, the heat resistance is reduced to cause a cracking during operation of the engine. If the average diameter of the precipitates and crystallizates in the sliding portion is less than 5 μm, the wear resistance may be reduced, whereas if such average diameter is more than 50 μm, the strength is reduced.

Yet further, according to the present invention, there is provided a heat resistance slide member for an internal combustion engine, wherein the slide member includes a high-temperature exposed portion requiring a heat resistance and a sliding portion connected to the high-temperature exposed portion, the high-temperature exposed portion and the sliding portion being formed of the quenched and solidified aluminum alloy matrix and a reinforcing fiber, the average aspect ratio of the reinforcing fiber present in the high-temperature exposed portion being set at a larger level, and the average aspect ratio of the reinforcing fiber present in the sliding portion being set at a smaller level than that of the reinforcing fiber present in the high-temperature exposed portion.

The above construction makes it possible to improve the high-temperature strength of the high-temperature exposed portion exposed to a high temperature and improve the wear resistance of the sliding portion.

Yet further, according to the present invention, there is provided a heat resistant slide member for an internal combustion engine, which is formed of an aluminum alloy matrix having a tensile strength at 300° C. of 10 $kg/mm^2$ or more, and a ceramic fiber having a volume fraction Vf of 3% or more and 25% or less, and having a tensile strength at 300° C. of 20 $kg/mm^2$.

The above construction makes it possible to provide a slide member which is light-weight and has excellent high-temperature strength and sliding characteristic and a good productivity by a hot extrusion or the like.

However, if the tensile strength of the matrix at 300° C. is less than 10 $kg/mm^2$, the strength of the slide member itself cannot be improved even if the ceramic fiber is incorporated therein.

In addition, if the volume fraction of the ceramic fiber is less than 3%, no high-temperature strength improving effect can be obtained. On the other hand, if the volume fraction is more than 25%, and in producing a powder compact by utilizing a powder metallurgical process, the moldability of the powder compact is degraded and moreover, the workability of the compact is also unsatisfactory, resulting in an increased manufacture cost.

Further, if the tensile strength of the slide member at 300° C. is less than 20 $kg/mm^2$, the high-temperature strength is reduced, attendant with a declined tension, resulting in increased amounts of gas blown-by and oil consumed when the slide member is a piston ring.

The above and other objects, features and advantages of the invention will become apparent from the following description of the preferred embodiments, taken in conjunction with the accompanying drawings.

Figure 4B:
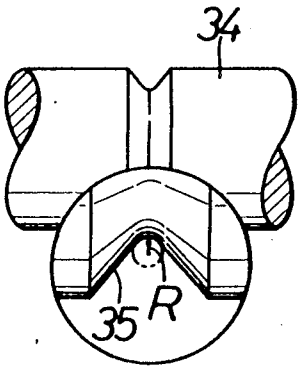
FIG. 4 is a graph illustrating a relationship between the Cr content and the notch proof strength ratio as well as the 5 kg.m Charpy absorption energy.
FIG. 4A is a view illustrating a structure of the intake valve.
Figure 4:
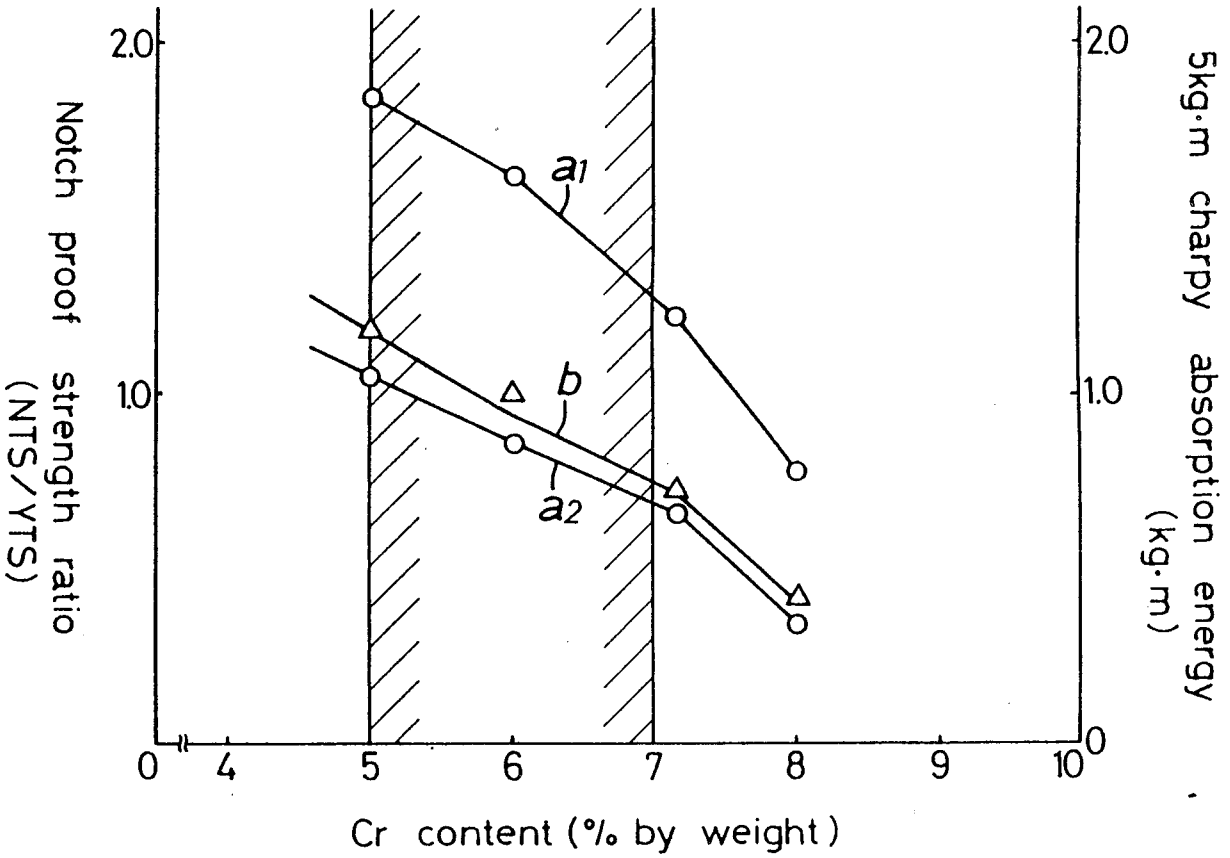

FIG. **4*b* is an elevation view with an enlarged portion illustrating the shape of the test piece for which the test results are illustrated in FIG. 4**.

Figure 6A:
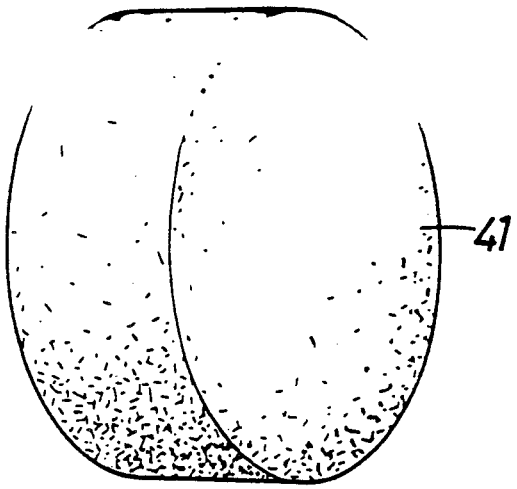
Figure 6B:
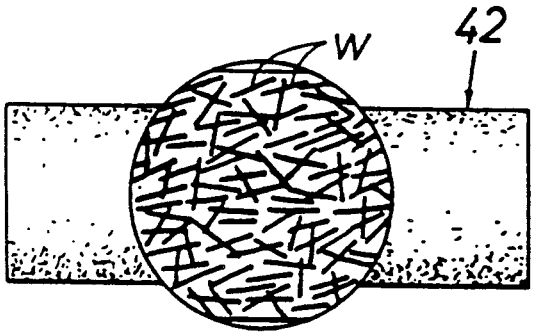
Figure 6D:
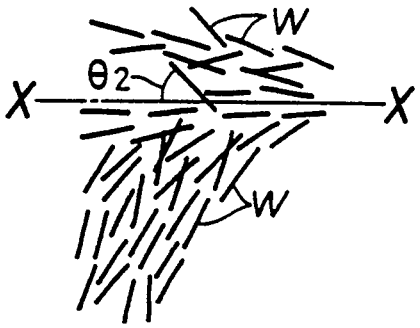
Figure 6C:
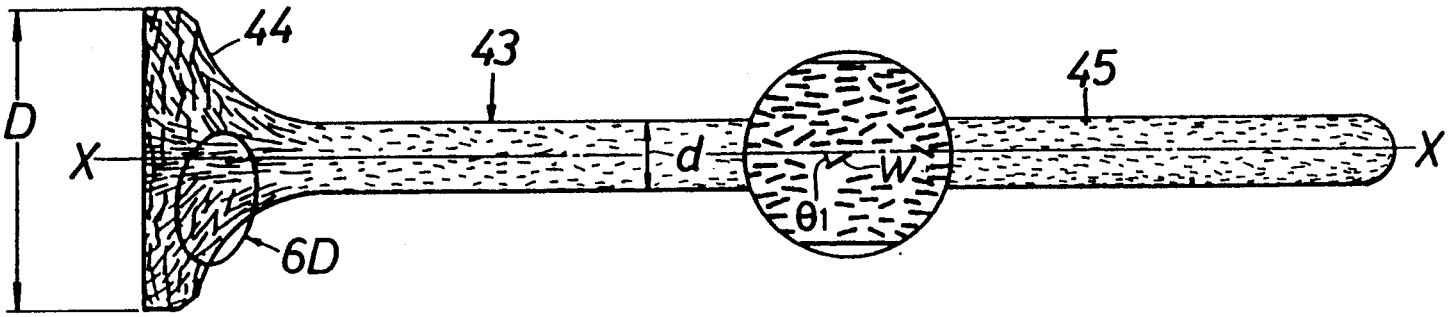
Figure 7:
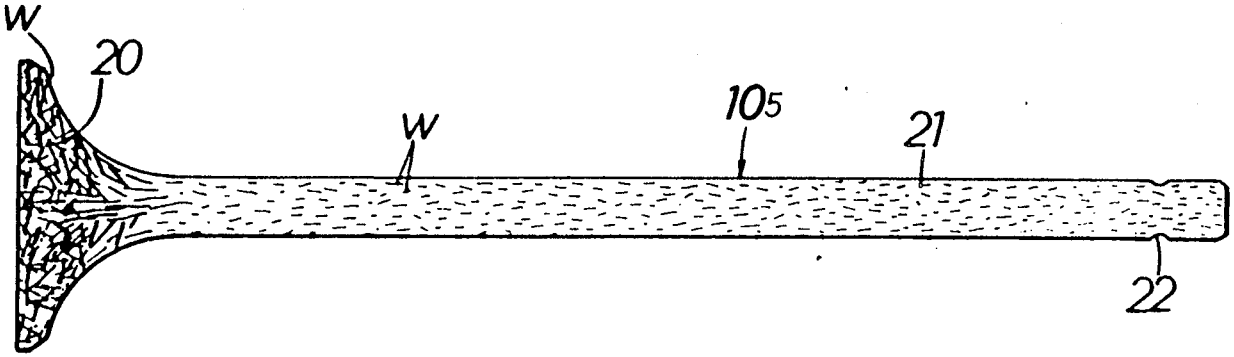
Figure 8:
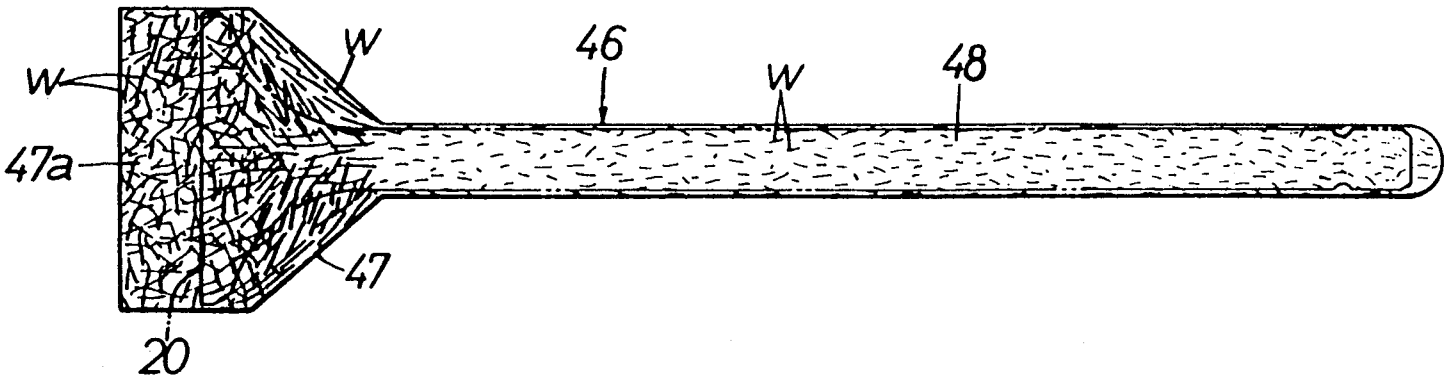
Figure 9:
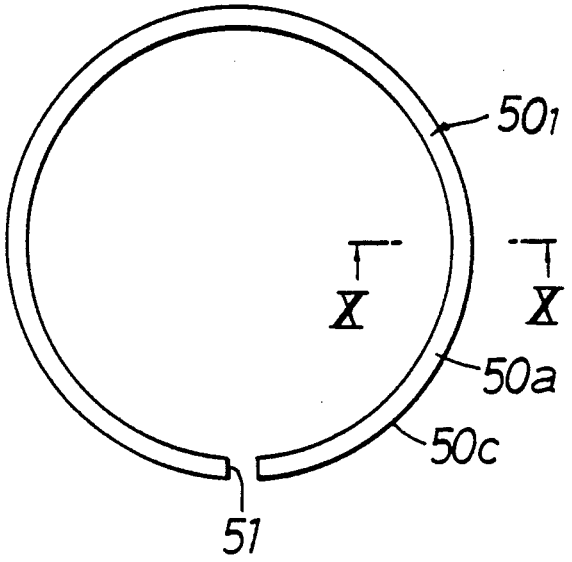
Figure 10:
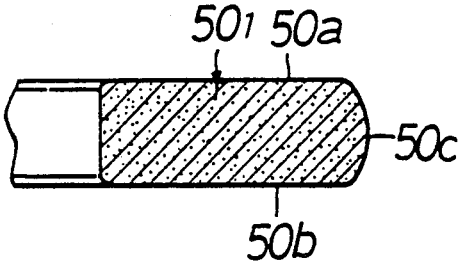
Figure 11:
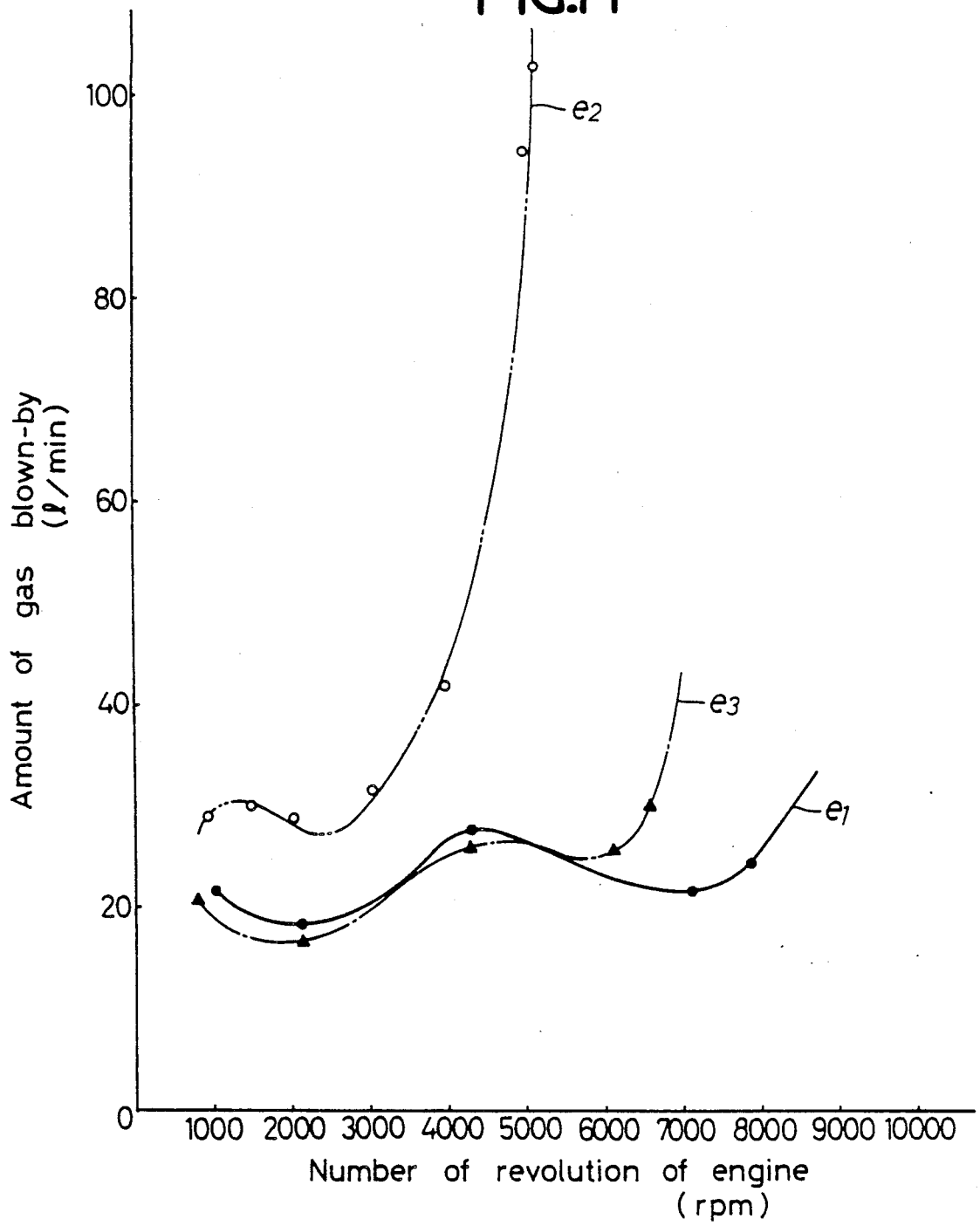
Figure 12A:
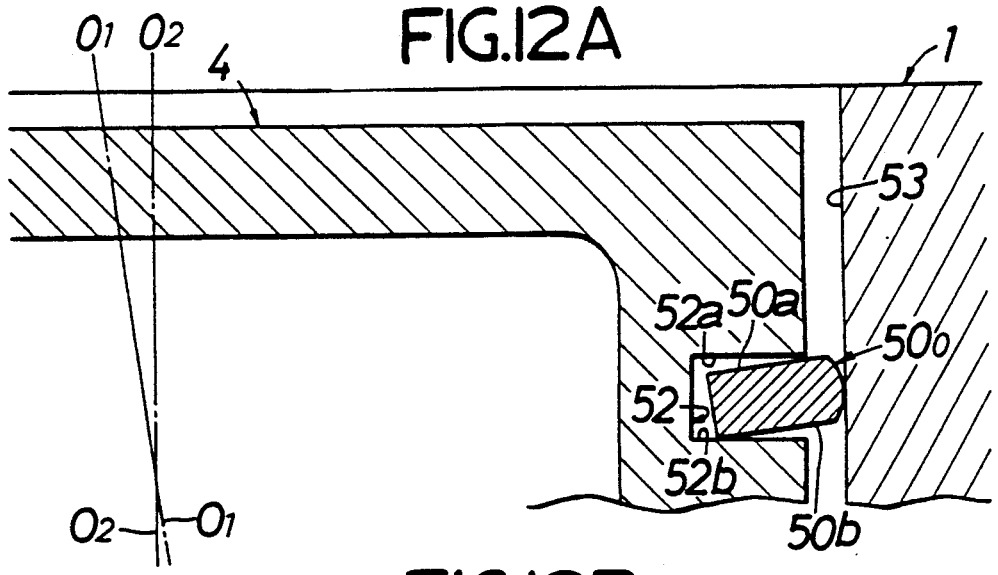
Figure 12B:
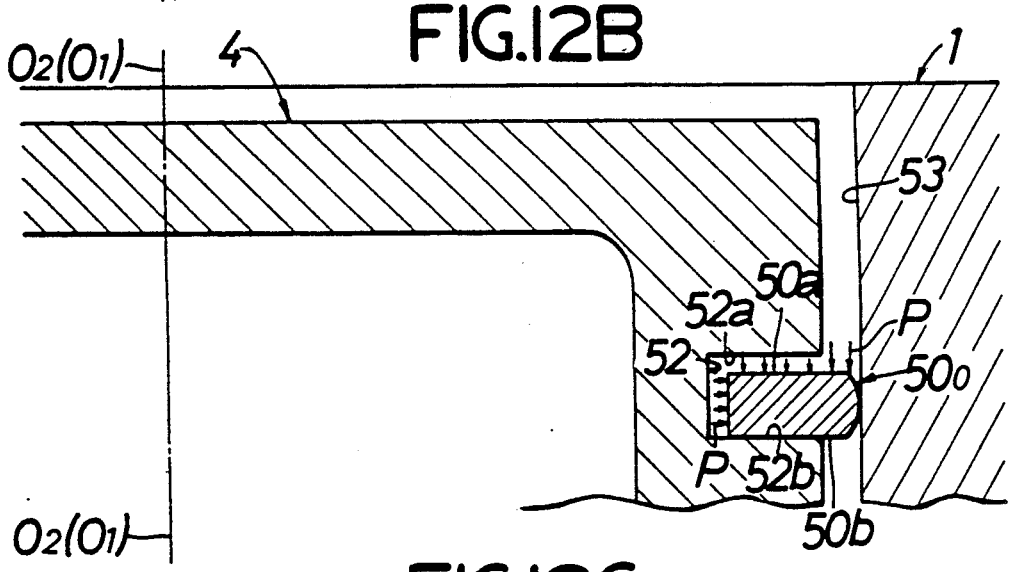
Figure 12C:
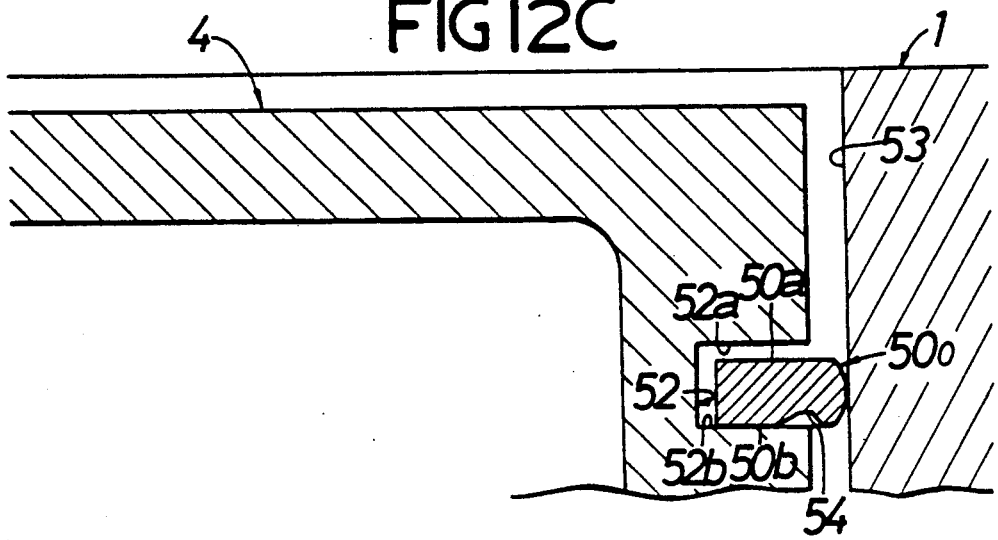
Figure 13:
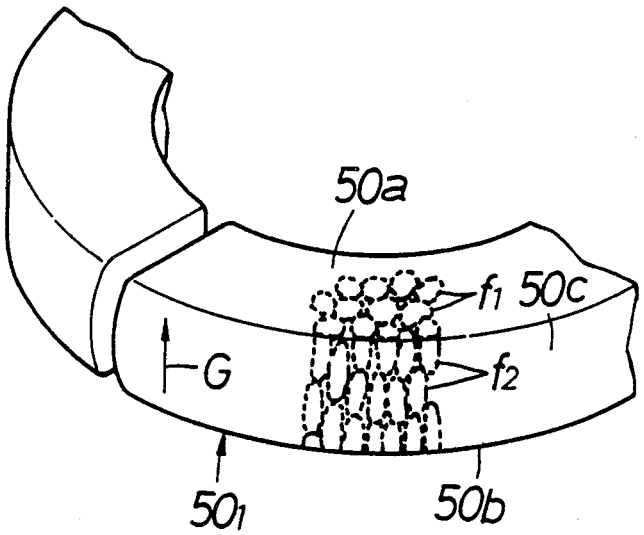
Figure 14:
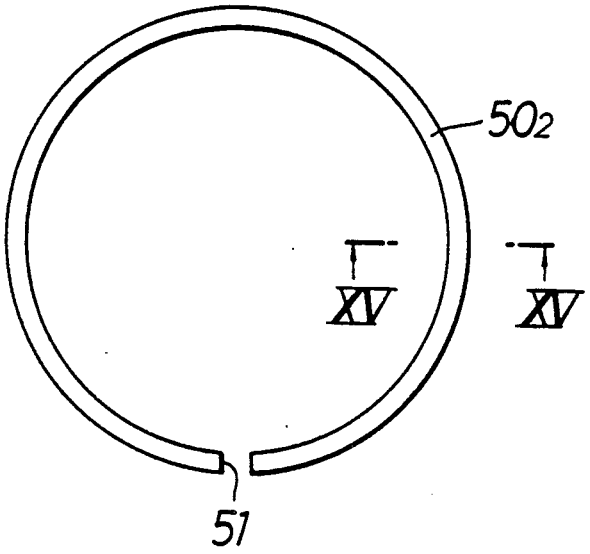

FIGS. 5A to 5E are views for explaining a process for producing a second intake valve;

FIGS. 6A to 6E are views for explaining a process for producing a third intake valve, FIG. 6D being an enlarged view of a portion indicated by an arrow 6D in FIG. 6C;

FIG. 7 is a view of the third intake valve;

FIG. 8 is a view of a preform used to produce the intake valve shown in FIG. 7;

FIG. 9 is a plan view of a first piston ring;

FIG. 10 is a sectional view taken along a line X—X in FIG. 9;

FIG. 11 is a graph illustrating a relationship between the number of revolutions of an engine and the amount of gas blown-by;

FIGS. 12A to 12C are views for illustrating a behavior of the piston ring during operation of the engine;

FIG. 13 is a view illustrating a structure of the piston ring;

FIG. 14 is a plan view of a second piston ring; and

Figure 15:
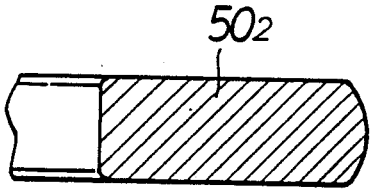

FIG. 15 is a sectional view taken along a line XV—XV in FIG. 14.

DESCRIPTION OF THE PREFERRED EMBODIMENTS

EXAMPLE 1

Figure 1:
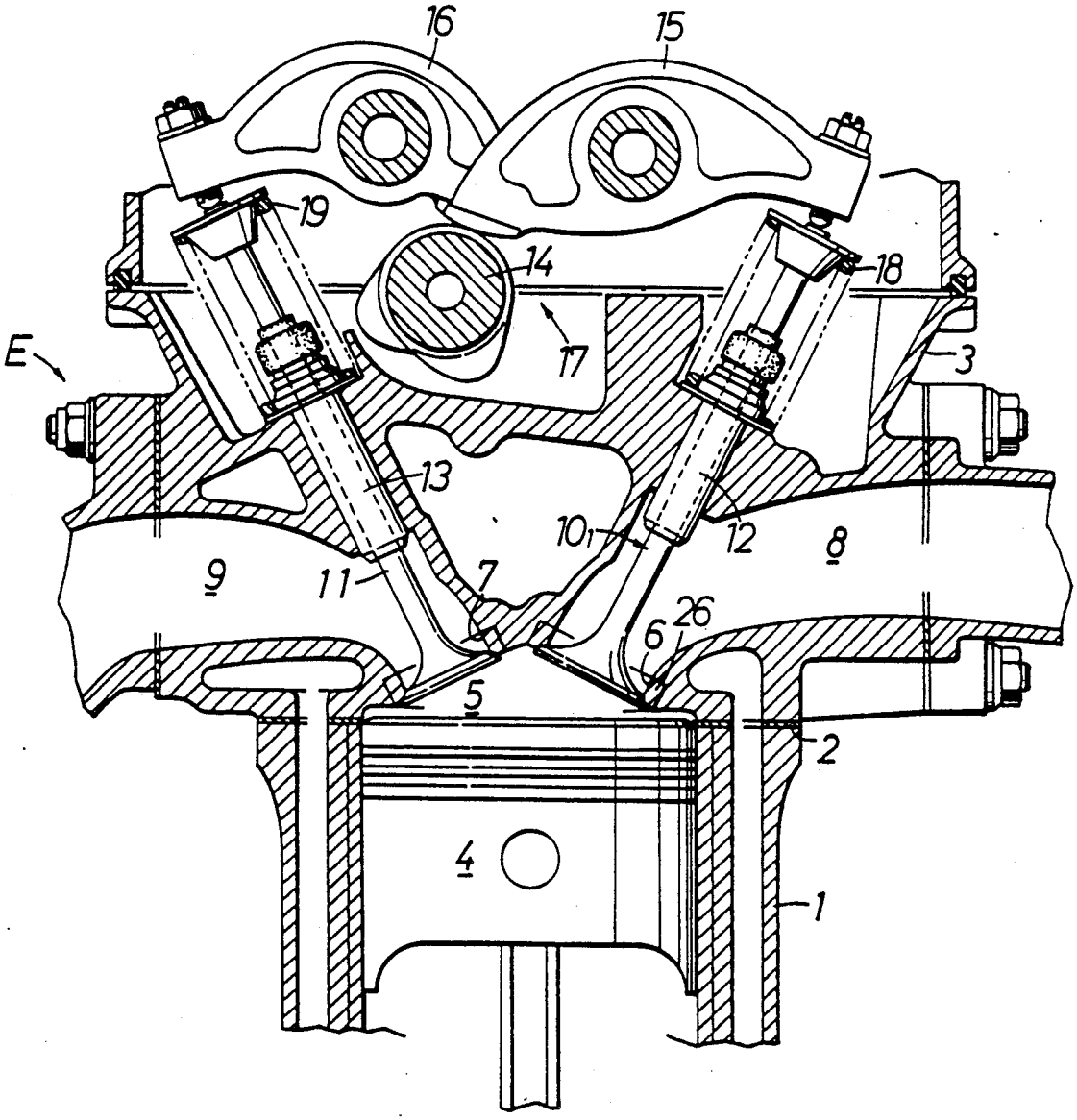
FIG. 1 is a front view in longitudinal section of an internal combustion engine.

In an OHC type internal combustion engine E shown in FIG. 1, a cylinder head 3 is mounted on a deck surface of a cylinder block 1 with a gasket 2 interposed therebetween. The cylinder head 3 is provided with a combustion chamber 5 facing an upper surface of a piston 4, and intake and exhaust ports 8 and 9 respectively having intake and exhaust valve bores 6 and 7 opened into the combustion chamber 5. The intake port 8 is connected to an intake system which is not shown, and the exhaust port 9 is connected to an exhaust system which is not shown. Intake and exhaust valves $10_1$ and 11 are slidably carried in a v-shape in the cylinder head 3 through valve guides 12 and 13, respectively, and adapted to open and close the intake and exhaust valve bores 6 and 7. The intake and exhaust valves $10_1$ and 11 are opened and closed at a predetermined timing by cooperation of a valve operating mechanism 17 including a cam shaft 14 and rocker arms 15 and 16 with valve springs 18 and 19.

Figure 2:
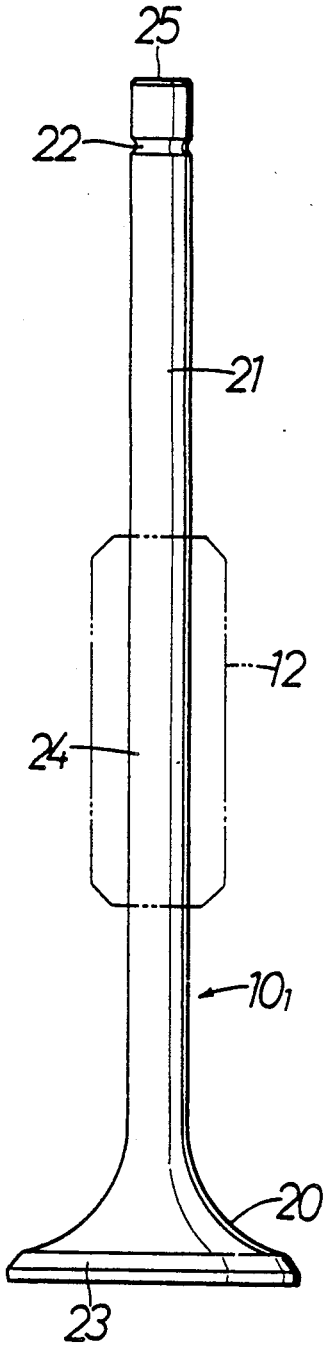
FIG. 2 is a front view of an intake valve.

Referring to FIG. 2, the intake valve $10_1$ as a slide member is formed from a quenched and solidified aluminum alloy and comprises an umbrella-type valve head 20 as a high-temperature exposed portion, and a valve stem 21 as a sliding portion connected to the valve head 20. The valve stem 21 is provided at its end with an annular retainer mounting groove 22.

The aluminum alloy which is used includes those comprising Cr, Fe and Zr in amounts of $4 \leqq Cr \leqq 10\%$ by weight, $0.5 \leqq Fe \leqq 4\%$ by weight and $0.5\% \leqq Zr \leqq 3\%$ by weight, and the balance of Al including unavoidable impurities.

To produce the intake valve $10_1$, a powder metallurgy process is utilized. Therefore, the aluminum alloy is used in the form of a powder. For the production of such powder, a quenching and solidifying process is utilized such as a gas atomizing process, a roll process or a centrifugal spray process. The cooling rate in this case is of $10^{2°}$ to $10^{6°}$ C./sec.

The production of the intake valve $10_1$ is performed by use of the following steps: a step of forming a powder compact by a two-stage or multi-stage powder compact formation using a uniaxial pressing process or CIP (cold isostatic pressing) process, a blank producing step utilizing a hot extrusion, a step of forming a preform having the same shape as an intended intake valve by a hot extrusion, a step of finishing the shape by machining, and a step of forming a hard layer on at least one selected from a valve seat abutting surface 23 which is an abutment surface of the valve head 20, a valve guide slide surface 24 which is a slide surface of the valve stem 21, and an end face of the valve stem 21 abutting against the rocker arm 15, as required.

For the formation of the hard layer, there is utilized a process for forming an alloy layer by a flame spraying (including a jet spraying) or a plating or by use of a high energy such as a laser. Materials which are used for the flame spraying include various alloys such as $Cr_3C_2$, WC $Al_2O_3$ and the like. Illustrative of the plating process are dry plating processes such as an ion plating and a vapor deposition, and a hard chromium plating process. Further, in forming an alloy layer, a simple powder or an alloy powder such as Fe, Ti, Ni, Mo, Cr, etc., is employed as an additive, and as required, a ceramic powder such as WC, SiC, $Si_3N_4$, etc., or a carbon powder is used.

Table 1 illustrates various physical properties of aluminum alloys $A_1$ to $A_{10}$ used in the present invention and aluminum alloys $B_1$ to $B_6$ as comparative examples. In an intake valve $10_1$ made using such an alloy by utilizing a usual powder metallurgy, process the Cr content is uniform over the entire intake valve.

TABLE 1

| Alumi. alloy | Chemical constituents (% by weight) Cr | Fe | Zr | Tensile strength (Kg/mm²) R.T. | 300° C. | Elongation (%) R.T. |
|---|---|---|---|---|---|---|
| $A_1$ | 4 | 3 | 2 | 40 | 18 | 9.5 |
| $A_2$ | 5 | 3 | 2 | 54 | 27 | 8.5 |
| $A_3$ | 6 | 3 | 2 | 57 | 30 | 6.5 |
| $A_4$ | 6 | 0.5 | 2 | 53 | 21 | 9.0 |
| $A_5$ | 6 | 4 | 2 | 58 | 31 | 4.0 |
| $A_6$ | 6 | 3 | 0.5 | 58 | 25 | 8.7 |
| $A_7$ | 6 | 3 | 3 | 58 | 31 | 4.0 |
| $A_8$ | 7 | 3 | 2 | 61 | 32 | 3.0 |
| $A_9$ | 8 | 3 | 2 | 61 | 32 | 2.5 |
| $A_{10}$ | 10 | 3 | 2 | 63 | 33 | 1.5 |
| $B_1$ | 3 | 3 | 2 | 35 | 12 | 12.0 |
| $B_2$ | 6 | 0.3 | 2 | 32 | 10 | 11.5 |
| $B_3$ | 6 | 5 | 2 | 60 | 34 | 0.5 |
| $B_4$ | 6 | 3 | 0.3 | 45 | 12 | 9.8 |
| $B_5$ | 6 | 3 | 4 | 59 | 33 | 0.5 |
| $B_6$ | 11 | 3 | 2 | 63 | 35 | 0 |

R.T.: Room temperature

As apparent from Table 1, it is possible to improve the high-temperature strength and toughness of the aluminum alloys $A_1$ to $A_{10}$ and thus the various intake valves $10_1$ by specifying the contents of Cr, Fe and Zr as described above. Moreover, the aluminum alloys $A_1$ to $A_{10}$ can be improved in hot extrudability in the intake valve producing process, because they have predetermined elongations. In order to provide such physical properties, it is desirable that the maximum diameter of precipitates and crystallizates in the aluminum alloys $A_1$ to $A_{10}$ is of 10 μm or less.

The metal flow pattern at the valve head 20 is in a direction perpendicular to a sliding direction and thus, is in a radial direction, due to the employment of the step for forming a preform by the hot extrusion, while the metal flow pattern at the valve stem 21 is in the slide direction and thus in an axial direction. This leads to an improvement in toughness of the valve head 20 adapted to seat on the valve seat 26 and that of the valve stem 21 subjected to an axial stress by the rocker arm 15 and the valve spring 18.

Further, it is possible to enhance the wear resistance of the intake valve $10_1$ by the formation of the hard layer.

Description will now be made of another example of the production of an intake valve $10_2$ according to the present invention with reference to FIGS. 3A to 3E.

(a) Powder Compact Forming Step

Three types of quenched and solidified aluminum alloy powders $C_1$ to $C_3$ having compositions given in Table II were produced.

TABLE II

| Aluminum alloy powder | Chemical constituents (% by weight) Cr | Fe | Zr |
|---|---|---|---|
| $C_1$ | 8 | 3 | 2 |
| $C_2$ | 5 | 3 | 2 |
| $C_3$ | 4 | 3 | 2 |

Figure 3A:
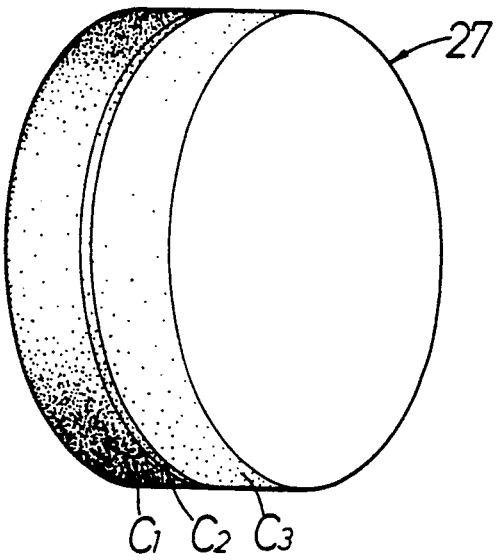
FIGS. 3A to 3E are views for explaining a process of producing a first intake valve.

The aluminum alloy powders $C_1$ to $C_3$ were placed into a uniaxial press, for example, in sequence of the powders $C_1$, $C_2$ and $C_3$, and subjected to a two-stage powder compact forming step to provide a short columnar layered powder compact 27 having first to third layers $C_1$ to $C_3$, as shown in FIG. 3A (for convenience, they are indicated by the same characters as the powders). The powder compact 27 has a diameter of 60 mm, a length of 30 mm and a relative density of 70%. The thickness of each of the first and third layers $C_1$ and $C_3$ was of 14 mm, and the thickness of the second layer $C_2$ was of 2 mm.

(b) Blank Making Step

Figure 3B:
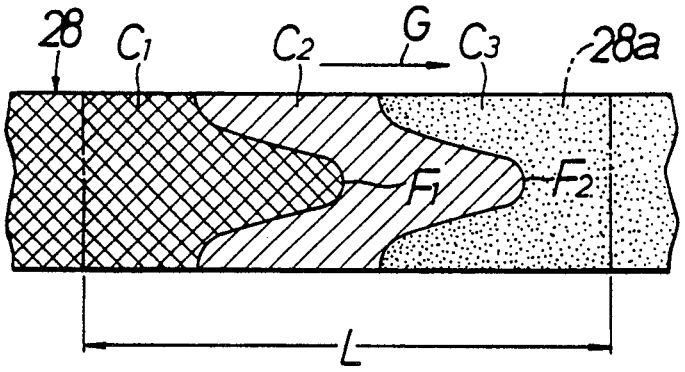

The powder compact was heated to a temperature of 400° to 500° C. and then placed into a container of an extruder so that the third layer $C_3$ thereof was positioned at the front side in an extruding direction, where it was subjected to a hot extrusion to provide a rounded rod 28 having a diameter of 30 mm, a length of 85 mm and a relative density of 100%, as shown in FIG. 3B. In this rounded rod 28, a boundary $F_1$ between the first and second layers $C_1$ and $C_2$ and a boundary $F_2$ between the second and third layers $C_2$ and $C_3$ extend in an extruding direction G in the form of a generally circular cone. A blank 28*a* having a length of 40 mm and including the boundaries $F_1$ and $F_2$ was cut from the rounded rod 28, so that a valve head 20 and a valve stem 21 were finally formed respectively from the first layer $C_1$ and the second and third layers $C_2$ and $C_3$ through the subsequent steps.

(c) Step for Forming Preform Having Intake Valve Shape

Figure 3C:
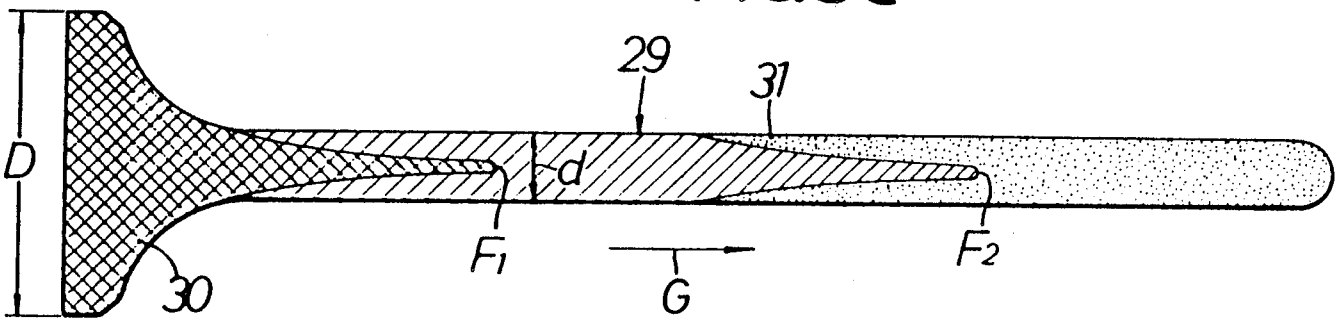

The blank 28*a* was heated to a temperature of 400° to 500° C. and then placed into a container of an extruder so that the third layer $C_3$ thereof was positioned at the front side in the extruding direction G, where it was subjected to a hot extrusion to give a preform 29 having an intake valve shape as shown in FIG. 3C. In this case, if the diameter of a valve head forming portion 30 in the preform 29 was represented by D, and the diameter of a valve stem forming portion 31 was by d, a ratio of the diameters D/d was set at $1.5<D/d<10$, and in this example of the production, D=30 mm, and d=10 mm. The boundaries $F_1$ and $F_2$ of the preform 29 were further extended in the extruding direction G by the extrusion.

(d) Shape Finishing Step

Figure 3D:
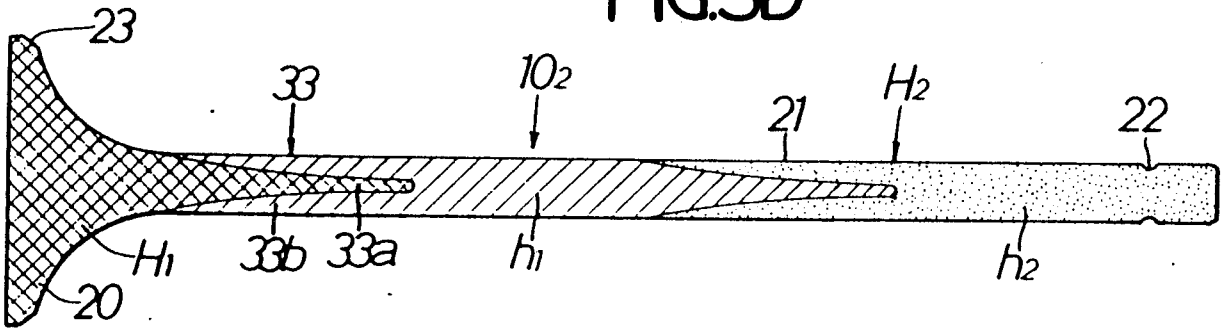

The preform 29 was subjected to a machining to remove its excessive thick wall portion to provide an intake valve $10_2$ with a retainer mounting groove 22 formed therein, as shown in FIG. 3D.

(e) Hard layer Forming Step

Figure 3E:
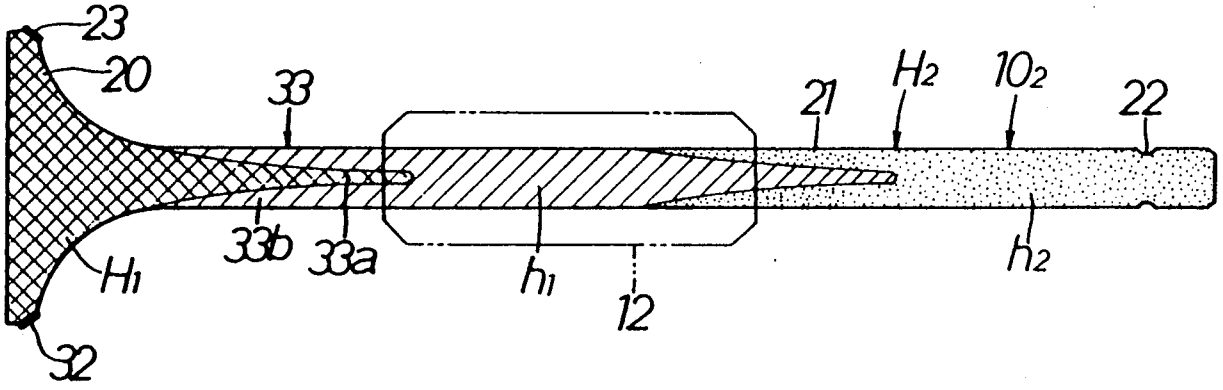

Using a product under the trade name of LCO-17 (which comprises 90% by weight of a Co-Cr alloy and 10% by weight of $Al_2O_3$) as a flame spraying metarial, a hard layer 32 having a thickness of 50 μm was formed on a valve seat abutting surface 23 of a valve head 20 as shown in FIG. 3E by application of a flame spraying process (a jet spraying process).

The intake valve $10_2$ includes a first region $H_1$ having a larger Cr content and extending over the entire valve head 20 and a portion of the valve stem 21 connected to the valve head 20, and a second region $H_2$ having a smaller Cr content than that in the first region $H_1$ and extending over the remaining portion of the valve stem 21. More specifically, the Cr content is of 8% by weight in the first region $H_1$, and the second region $H_2$ comprises a first section $h_1$ having a Cr content of 5% by weight and a second section $h_2$ having a Cr content of 4% by weight.

Such an adjustment of the Cr content increases the high-temperature strength of the valve head 20 exposed to a high temperature, and on the other hand, enhances the toughness of the valve stem 21. In this case, the metal flow pattern likewise contributes to an enhancement in toughness of the valve head 20 and the valve stem 21. Because the second section $h_2$ of the valve stem 21 has a smaller Cr content and a higher toughness than those in the first section $h_1$ the retainer mounting groove 22 and its vicinity exhibit an excellent durability against a load provided by the rocker arm 15 and the valve spring 18.

In the connection portion 33, a central portion 33*a* is included in the first region $H_1$, and an outer layer portion 33*b* surrounding the central portion 33*a* is included in the second region $H_2$. Therefore, the connection portion 33 is of a double structure with a highly strong portion surrounded by a highly tough portion, leading to an improved strength of the connection portion 33 where a concentration of stress is liable to occur.

To obtain the above-described physical properties, the Cr content of the first region $H_1$ is set at $6 \leqq CR \leqq 10\%$ by weight, and the Cr content of the second region $H_2$ is set at $4 \leqq Cr < 6\%$ by weight. In this case, a suitable Cr content in the first section $h_1$ is of $5 \leqq Cr < 6\%$ by weight, and a suitable Cr content in the second section $h_2$ is of $4 \leqq Cr < 5\%$ by weight.

For comparison, using the comparative aluminum alloys $B_1$ and $B_6$ given in Table I, two types of intake valves uniform in Cr content over the whole thereof were made through similar steps.

An actual durability test was conducted at a number of revolutions of engine of 6,000 rpm for an operation period of 100 hours for the intake valve $10_2$ having the first and second regions $H_1$ and $H_2$ according to the present invention and the comparative intake valves. This test showed that any abnormality was not observed in the intake valve $10_2$ of the present invention, but in the intake valve having a Cr content of 11% by weight, cracks were produced at an end of the valve stem, and in the intake valve having a Cr content of 3% by weight, a thermal deformation was produced at the valve head.

FIG. 4 illustrates a relationship between the Cr content when Fe and Zr contents are set respectively at 3% and 2% by weight and the notch proof strength ratio (NTS/YTS) as well as the 5 kg,m Charpy absorption energy. In this case, as shown in FIG. 4*b*, the test piece 34 used was a rounded rod-like piece having a notch 35. NTS indicates the tensile strength of the test piece having the notch, and YTS indicates the 0.2% proof strength. R represents a radius of a bottom in the notch 35, and a line $a_1$ corresponds to a notch proof strength ratio when R=1.10 mm (a shape factor $\alpha=8.00$), and a line $a_2$ corresponds to a notch proof strength ratio when R=0.02 mm ($\alpha=1.94$). A line b indicates a Charpy absorption energy.

As can be seen from FIG. 4, the Cr content is preferably of $5 \leqq Cr \leqq 7\%$ by weight.

Figure 4A:
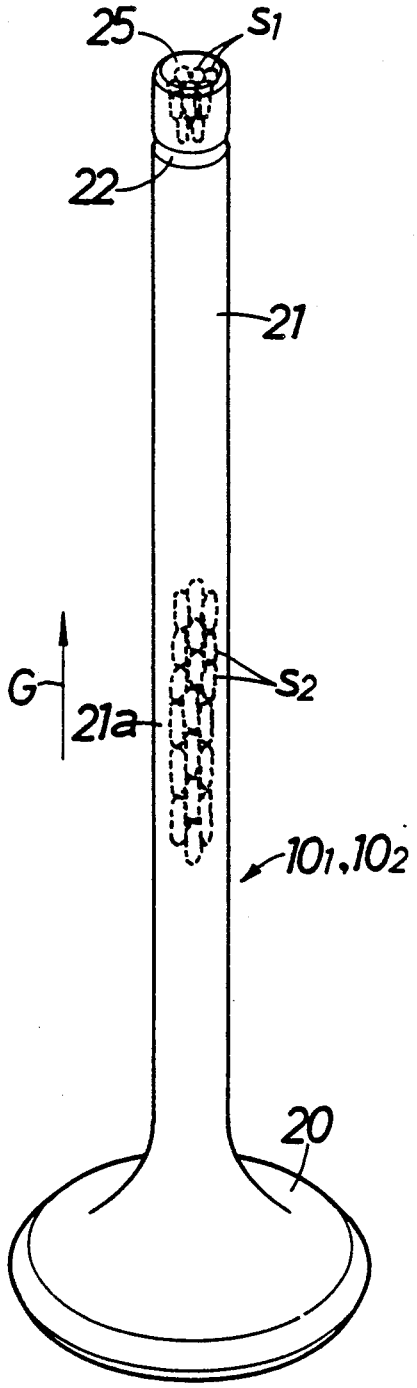

In the valve stem 21 of the intake valve $10_1$, $10_2$, the aluminum alloy powder is extended in the extruding direction G with the metal flow pattern in the same direction, as clearly shown in FIG. 4A, and at this time, the hard oxide (mainly, $Al_2O_3$) surrounding the alloy powder is broken into micro-pieces which exist at a particle field of the aluminum alloy. This results in that an infinite number of groups $S_1$ of micro-pieces each formed into a generally very small circle are distributed over an end face 25 of the valve stem 21 and that an infinite number of groups $S_2$ of micro-pieces each formed into a generally very small oval with its lengthwise axis turned in the extruding direction G are distributed over a sliding surface 21*a* adpated to come into slide contact with the valve guide 12.

Thus, the concentration of the micro-pieces is higher at the end face 25, leading to an increased wear resistance of the end face 25 in the slide contact with the rocker arm 15, while the concentration of the micropeices is lower at the slide surface 21*a*, leading to a suppressed wearing of the valve guide 12. In addition, a good wear resistance of the slide surface 21*a* can be also obtained by insuring a given area rate.

Another procedure which can be used for producing an intake valve according to the present invention is as follows.

Using an aluminum alloy powder having a larger Cr content, a billet for a valve head is produced through a CIP (cold isostatic pressing) process and an extrusion. Another billet for a valve stem is also produced using an aluminum alloy powder having a smaller Cr content than that of the just-described powder. Thereafter, both the billets are subjected, in an abutting condition, to a hot extrusion to provide a preform similar to that provided at the above-described step (c).

In this case, a billet for a valve head and two billets for a valve stem may be employed which have been produced by a similar procedure, using three type of aluminum alloy powders similar to those in Table II and having different Cr contents.

EXAMPLE II

Description will now be made of an intake valve $10_3$ used in an OHC type internal combustion engine as in Example I.

A quenched and solidified aluminum alloy used as a material for forming the intake valve $10_3$ is an alloy comprising Cr, Fe and Zr in amounts of $4 \leqq Cr \leqq 10\%$, $0.5 \leqq Fe \leqq 4\%$ and $0.5 \leqq Zr \leqq 3\%$ by weight and the balance of Al including unavoidable impurities.

The above-described quenching and solidifying process permits a coarse powder having a relatively large diameter and a fine powder having a relatively small diameter to be concurrently produced. For the coarse powder, powder particles having a diameter of 25 to 105 μm are cooled at a slower rate, so that the growth of precipitates and crystallizates proceed and consequently, the average diameter of the precipitates and crystallizates is of 5 μm or more and 50 μm or less. On the other hand, for the fine powder, powder particles having a diameter less than 25 μm may be cooled at a rapider rate, so that the growth of precipitates and crystallizates less proceed and consequently, the average diameter of the precipitates and crystallizates is less than 5 μm.

The following is a description of an example of the production of an intake valve $10_3$ according to the present invention with reference to FIGS. 5A to 5E.

(a) Powder Compact Forming Step

The quenched and solidified aluminum alloy powders prepared were a coarse powder for the valve stem containing 6% by weight of Cr, 3% by weight of Fe and 2% by weight of Zr and having an average diameter of precipitates and crystallizates of 25 μm (with diameters of 25 to 105 μm) and a fine powder for a valve head having a similar composition and an average diameter of precipitates and crystallizates of 2 μm (with diameters less than 25 μm).

The coarse and fine powders were placed, for example, in a sequence of the fine and coarse powders, into a uniaxial press where they were subjected to a two-stage powder compact forming process to provide a short columnar layered powder compact 36 including a first layer $K_1$ made of the fine powder and a second layer $K_2$ made of the coarse powder. The powder compact 36 had a diameter of 80 mm, a length of 40 mm and a relative density of 80%.

(b) Blank Making Step

Figure 5A:
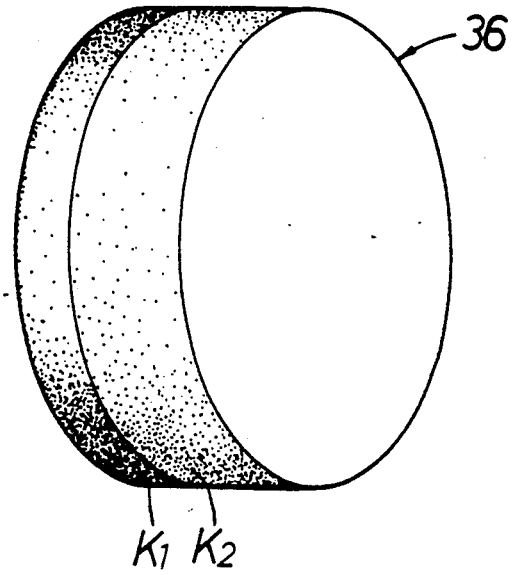
Figure 5B:
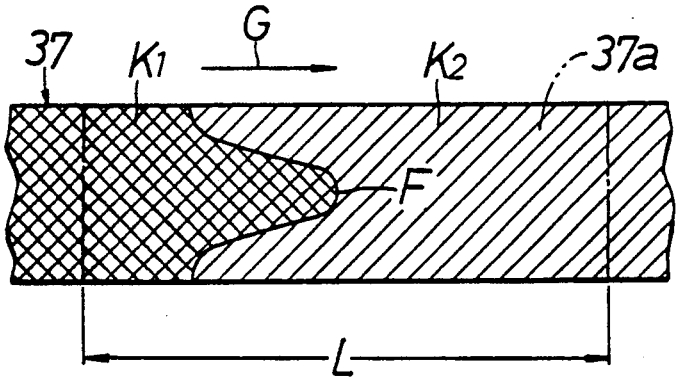

The powder compact 36 was heated to a temperature of 400° to 500° C. and then placed into a container of an extruder so that the second layer $K_2$ thereof was positioned at the front side in an extruding direction, where it was subjected to a hot extrusion to provide a rounded rod 37 having a diameter of 30 mm and a relative density of 100%, as shown in FIG. 5B. In this rounded rod 37, a boundary F between the first and second layers $K_1$ and $K_2$ extends in an extruding direction G in the form of a generally circular cone.

A blank 37*a* having a length L of 40 mm and including the boundary F was cut from the rounded rod 37, so that a valve head 20 and a valve stem 21 were finally formed respectively from the first layer $K_1$ and the second layer $K_2$ through the subsequent steps.

(c) Step for Forming Preform Having Intake Valve Shape

Figure 5C:
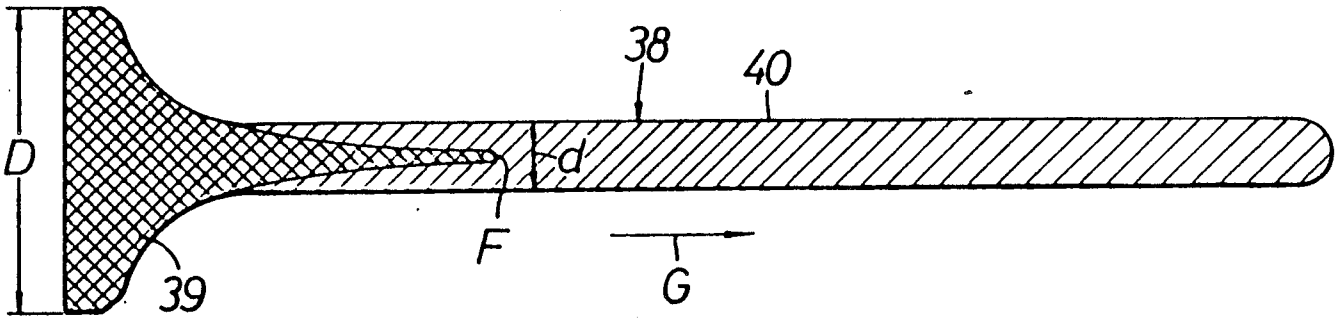

The blank 37*a* was heated to a temperature of 400° to 500° C. and then placed into a container of an extruder so that the second layer $K_2$ thereof was positioned at the front side in the extruding direction G, where it was subjected to a hot extrusion to give a preform 38 having an intake valve shape as shown in FIG. 5C. In this case, if the diameter of a valve head forming portion 39 in the preform 38 was represented by D, and the diameter of a valve stem forming portion 40 was by d, a ratio of the diameters D/d may be set at $1.5 < D/d < 10$, and in this example of the production, D = 30 mm, and d = 10 mm. The boundary F of the preform 38 were further stretched in the extruding direction G by the extrusion.

(d) Shape Finishing Step

Figure 5D:
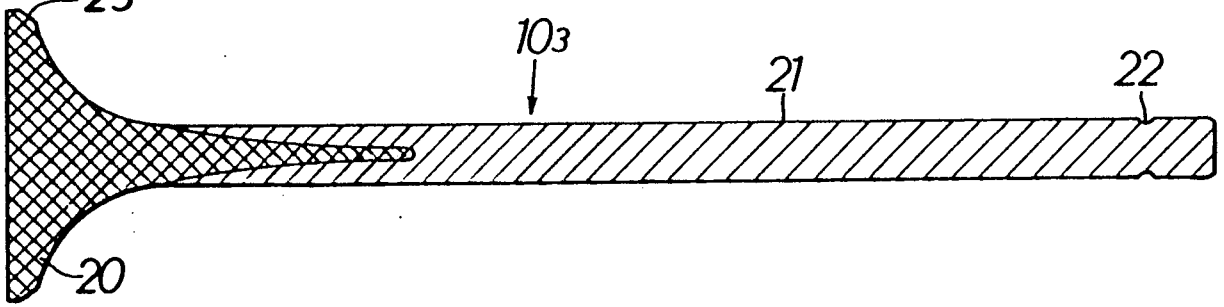

The preform 38 was subjected to a machining to give an intake valve $10_3$ with its excessive thick wall portion removed and with a retainer mounting groove 22 formed therein, as shown in FIG. 5D. The average diameters of precipitates and crystallizates in a valve head 20 and a valve stem 21 of the intake valve 103 was of 2 μm and 25 μm, respectively.

(e) Hard layer Forming Step

Figure 5E:
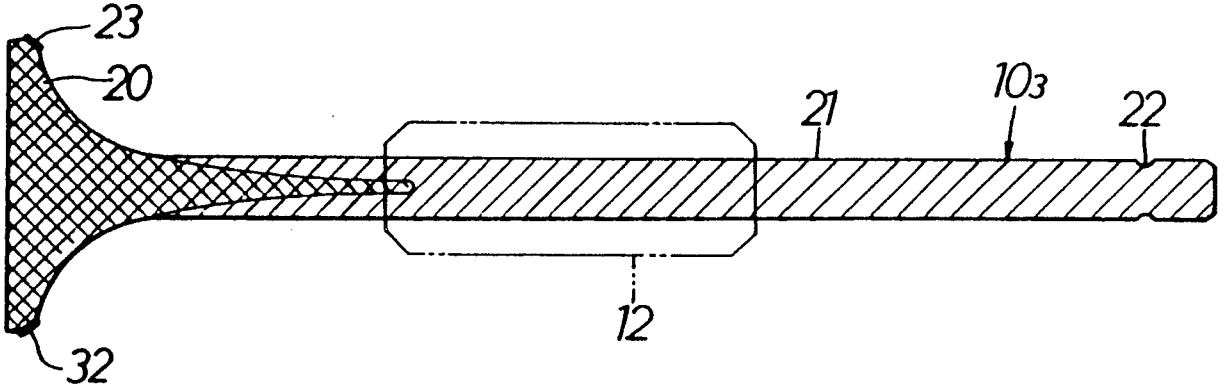

Using a product under the trade name of LCO-17 (which comprises 90% by weight of a Co-Cr alloy and 10% by weight of $Al_2O_3$) as a flame spraying metarial, a hard layer 32 having a thickness of 50 μm was formed on a valve seat abutting surface 23 of the valve head 20 as shown in FIG. 5E by application of a jet spraying process.

For comparison, an intake valve entirely formed from the above-described fine powder and an intake valve formed from the coarse powder and having an average diameter of precipitates and crystallizates of 50 μm (with diameters of 25 to 200 μm) were produced through similar steps to those as described above.

An actual durability test was conducted at a number of revolutions of engine of 6,000 rpm for an operation period of 100 hours for the intake valve $10_3$ according to the present invention and for the comparative intake valves to provide results given in Table III.

TABLE III

| | A.D. of precipitates and the like (μm) | | Results of Test | |
|---|---|---|---|---|
| Intake valve | V.H. | V.S. | V.H. | V.S. |
| present invention | 2 | 25 | no abno. | no abno. |
| Comparative valve | 2 | 2 | no abno. | worn |
| Comparative valve | 50 | 50 | cracked | no abno. |

A.D. = Average diameter
V.H. = Valve head
V.S. = Valve stem
no abno. = no abnormality As apparent from Table III, the intake valve $10_3$ according to the present invention has a good heat resistance of the valve head 20 and a good wear resistance of the valve stem 21.

In producing the intake valve according to the present invention, the following methods (i) and (ii) can also be employed.

Method (i):

Using the above-described coarse powder, a billet for a valve stem is produced through CIP (cold isostatic pressing) process and an extrusion. In addition, using the above-described fine powder, a billet for a valve head is produced by the same procedure. Thereafter, the billet is subjected, in an abutting condition, to a hot extrusion to provide a preform similar to that provided at the above-described step (c).

Method (ii):

An intake valve entirely formed from the above-described fine powder is produced through similar steps. Then, a valve stem of the intake valve is subjected to an electrically heating treatment or a high energy heating treatment using a laser or the like, thereby providing the growth of precipitates and crystallizates in the valve stem.

In this case, the use of the high energy heating treatment permits a selective treatment of any place of the valve stem and makes it possible to provide the growth of the precipitates and crystallizates to enlarge the same in size only in a surface layer of the valve stem.

It should be noted that the same as the description with reference to FIG. 4A is true with the intake valve $10_3$.

EXAMPLE III

Figure 6E:
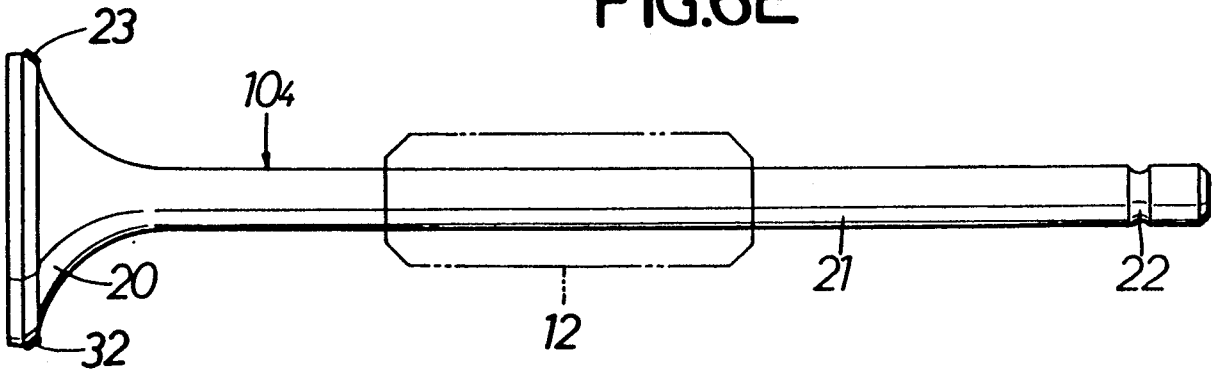

As shown in FIG. 6E, an intake valve $10_4$ comprises a umbrella-type valve head 20 similar to that shown in FIG. 2 and a valve stem 21 connected to the valve head 20. An annular retainer mounting groove 22 is made at an end of the valve stem 21.

The valve head 20 and the valve stem 21 are formed from silicon carbide whiskers as a reinforcing fiber and an aluminum alloy as a light alloy matrix. The volume fraction Vf of the silicon carbide whiskers is set at 2% or more and 20% or less.

The aspect ratio of the silicon carbide whiskers is represented by $l_1/d_1$ wherein $l_1$ is a length of the whisker, and $d_1$ is a diameter of the whisker.

The average aspect ratio of the silicon carbide whiskers present in the valve head 20 is set at a larger level, e.g., at 50 or less and 3 or more, preferably at 15 or more, and the average aspect ratio of the silicon carbide whiskers present in the valve stem 21 is set at a smaller level than that in the valve head 20, e.g., at 15 or less and 2 or more.

Such a construction provides an improved high-temperature strength of the valve head 20 which is exposed to a high temperature, and an improved wear resistance of the valve stem 21 which slides on the valve guide 12.

However, if the average aspect ratio in the valve head 20 is less than 3, the high-temperature strength improving effect resulting from the compounding cannot be obtained. On the other hand, if such average aspect ratio is more than 50, the silicon carbide whiskers cannot be uniformly distributed, and the notch effect of the silicon carbide whiskers may be increased to provide a reduced high-temperature strength of the valve head 20.

In the valve stem 21, if the average aspect ratio exceeds 15, the effect of improving the wear resistance of the valve stem 21 is reduced due to a concentration of the hard material. On the other hand, any average aspect ratio less than 2 will result in a reduced interfacial strength between the aluminum alloy and the silicon carbide whiskers, which will cause an increased falling of the silicon carbide whiskers from the aluminum alloy, leading to an increased amount of valve stem 21 worn.

As in Example 1, the quenched and solidified aluminum alloy used is an alloy comprising Cr, Fe and Zr in amounts of $4 \leqq Cr \leqq 10$, $0.5 \leqq Fe \leqq 4$ and $0.5 \leqq Zr \leqq 3$ and the balance of Al including unavoidable impurities.

The following is a description of the intake valve $10_4$ according to the present invention with reference to FIGS. 6A to 6E.

(a) Powder Compact Forming Step

For a quenched and solidified aluminum alloy powder, a powder was prepared which has an average diameter of 7 μm and contains 6% by weight of Cr, 3% by weight of Fe and 2% by weight of Zr. This powder was mixed with silicon carbide whiskers having an average length of 30 μm and an average diameter of 0.4 μm, i.e., an average aspect ratio of 75 (and a volume fraction of 10%), and the mixture was placed into a uniaxial press where it was subjected to a two-stage powder compact forming process to provide a short columnar powder compact 41 which had a diameter 80 mm, a length of 50 mm and a relative density of 80%.

(b) Blank Making Step

The powder compact 41 was heated to a temperature of 400° to 500° C. and then placed into a container of an extruder where it was subjected to a hot extrusion to provide a rounded rod having a diameter of 30 mm and a relative density 100%. Then, a blank 42 having a length of 40 mm was cut from the rounded rod, as shown in FIG. 6B.

In this blank 42, the silicon carbide whiskers w are orientated at ±30° with respect to a center line of the blank 42.

(c) Step for Forming Preform Having Intake Valve Shape

The blank 42 was heated to a temperature of 400° to 500° C. and then placed into a container of an extruder where it was subjected to a hot extrusion to give a preform 43 having an intake valve shape as shown in FIG. 6C. In this case, if the diameter of a valve head forming portion 44 in the preform 43 was represented by D, and the diameter of a valve stem forming portion 45 was by d, a ratio of the diameters D/d is set at $1.5 < D/d < 10$, and in this example of the production, D=30 mm, and d=10 mm.

In the valve stem forming portion 45 of the preform 43, folding of the silicon carbide whiskers w is produced due to the setting of the above-described ratio of the diameters and for this reason, the average aspect ratio thereof may be of 7 (to 2). On the other hand, in the valve head forming portion 44, the average aspect ratio of the silicon carbide whiskers w is of 18 (to 4) for the same reason.

With the above-described hot extrusion, a material flow pattern in a direction of an axis X—X of the intake valve is developed in the valve stem forming portion 45, while in the valve head forming portion 44, an axial material flow pattern is developed around an outer peripheral portion thereof, and a material flow pattern in a direction of the axis X—X of the intake valve is developed at a central portion thereof.

As a result, the average orientation angle $\theta_1$ of the silicon carbide whiskers w present in the valve stem forming portion 45 is of ±30° or less, e.g., ±8° with respect to the axis X—X of the intake valve as shown in FIG. 6C, and the average orientation angle $\theta_2$ of the silicon carbide whiskers w present in the valve head forming portion 44 is of ±6° or less, e.g., ±47° with respect to the axis X—X of the intake valve as shown in FIG. 6D.

The measurement of the average orientation angle is conducted by the following technique.

A plurality of straight lines are drawn, in parallel to the axis X—X of the intake valve, in a single dividing plane axially dividing the preform 43 into two portions so as to include the axis X—X of the intake valve, and a plurality of straight lines perpendicular to such straight lines are drawn, thereby describing a checkers-like lattice to determine the angles of the silicon carbide whiskers present at a plurality of intersections in the lattice with respect to the axis X—X of the intake valve and determine the average value of these angles.

(d) Shape Finishing Step

The preform 43 was subjected to a machining to give an intake valve $\mathbf{10_4}$ with its excessive thick wall portion removed and with a retainer mounting groove 22 formed therein, as shown in FIG. 6E.

(e) Hard layer Forming Step

Using a product under the trade name of LCO-17 (which comprises 90% by weight of a Co-Cr alloy and 10% by weight of $Al_2O_3$) as a flame spraying metarial, a hard layer 32 having a thickness of 50 μm was formed on a valve seat abutting surface 23 of the valve head 20 as shown in FIG. 6E by application of a jet spraying process.

If the average orientation angle $\theta_1$ of the silicon carbide whiskers present in the valve stem 21 is set at ±30° or less with respect to the axis X—X of the intake valve, as described above, a fiber reinforcing capability of the silicon carbide whiskers can be obtained to reduce the amount of valve stem 21 worn and increase the flexural strength of the valve stem 21. However, if the average orientation angle $\theta_1$ exceeds ±30°, the valve stem 21 will be worn in an increased amount.

If the average orientation angle $\theta_2$ of the silicon carbide whiskers w present in the valve head 20 is set at ±60° with respect to the axis X—X of the intake valve, the fiber reinforcing capability of the silicon carbide whiskers can be obtained to increase the impact value of the valve head 20 at a high temperature. However, if the average orientation angle $\theta_2$ exceeds ±60°, the above-described effect cannot be obtained.

Table IV illustrates a relationship between the average orientation angle $\theta_1$ and the worn amount in valve stems Nos. 1 to 4 of four intake valves. The average aspect ratio of the silicon carbide whiskers present in each of the valve stems was of 7, and the worn amount was measured after a actual durability test had been conducted at a number of engine revolutions of 6,000 rpm for an operation period of 100 hours.

TABLE IV

| Valve stem No. | Average orientation angle $\theta_1$ (°) | Worn amount (mm) | Estimation |
|---|---|---|---|
| 1 | +10 | 0.2 | superior |
| 2 | +15 | 0.5 | superior |
| 3 | +32 | 2.0 | inferior |
| 4 | +45 | 5.0 | inferior |

As apparent from Table IV, the wear resistance of the valve stem Nos. 1 and 2 can be improved by setting the average aspect ratio of the silicon carbide whiskers at 7 and the average orientation angle $\theta_1$ at ±30° or less.

Table V illustrates a relationship between the average aspect ratio of the silicon carbide whiskers and the high temperature strength in valve head Nos. 1 to 7 of seven intake valves. The high temperature strength is indicated in terms of a tensile strength at 300° C., and the average orientation angle $\theta_2$ of the silicone carbide whiskers present in each of the valve heads was of ±47°. In the column of Estimation in Table V, "good" means that the valve head has a tensile strength of 30 kg/mm² or more; "passible" means that the valve head has a tensile strength of 20 kg/mm² or more; and "failure" means that the valve head has a tensile strength of less than 20 kg/mm².

TABLE V

| Valve head No. | Average aspect ratio | Tensile strength (kg/mm²) | Estimation |
|---|---|---|---|
| 1 | 50 | 45 | good |
| 2 | 30 | 40 | good |
| 3 | 15 | 35 | good |
| 4 | 10 | 28 | passible |
| 5 | 5 | 25 | passible |
| 6 | 3 | 20 | passible |
| 7 | 2 | 17 | failure |

It is apparent from Table V that the high temperature strength of the six valve stem Nos. 1 to 6 can be improved by setting the average orientation angle $\theta_2$ at ±47° and the average aspect ratio at 50 or less and 3 or more, preferably at 15 or more.

EXAMPLE IV

FIG. 7 illustrates another alternate intake valve $\mathbf{10_5}$ according to the present invention. The average orientation angle $\theta_1$ of the silicon carbide whiskers w present in the valve stem 21 of the intake valve $\mathbf{10_5}$ was set at ±30° or less, but the silicon carbide whiskers w present in the valve head 20 were orientated at random.

If the silicon carbide whiskers w is orientated in this manner in the valve head 20, the thermal expansion of the valve head 20 can be suppressed.

In making the intake valve $\mathbf{10_5}$, a blank with silicon carbide whiskers orientated at random (corresponding to a blank 42 shown in FIG. 6B) is first prepared by utilizing a high pressure solidification casting process. Then, a preform 46 including a valve head forming portion 47 having a large unpressed portion **47*a* and a valve stem forming portion 48 is formed using this blank. In this unpressed portion 47*a*, a material flow pattern is little developed and hence, the silicon carbide whiskers are orientated at random. Thereupon, a valve head 20 is formed by cutting from the unpressed portion 47*a* by machining, as shown by a dashed line in FIG. 8**.

EXAMPLE V

A fiber-reinforced piston ring $\mathbf{50_1}$ as a slide member shown in FIGS. 9 and 10 is formed of an aluminum alloy matrix and a ceramic fiber. The matrix used is AA specification 2024 (Al-Cu based high strength aluminum alloy) having a tensile strength at 300° C. of 11 kg/mm², and the ceramic fiber used is SiC whiskers.

The following is a description of an example of the production of the piston ring.

(a) Using the molten aluminum alloy, a quenched and solidified aluminum alloy powder was prepared under a condition of a cooling rate of $10^{2°}$ to $10^{6°}$ C./sec by a gas atomizing process.

(b) The alloy powder was subjected to a classifying treatment to provide an alloy powder having an average particle size of 20 μm.

(c) The alloy powder and the SiC whiskers were mixed by addition of acetone thereto and then, the mixture was subjected to a drying treatment for 10 hours to remove the acetone.

(d) Using the mixture, a powder compact having a diameter of 160 mm, length of 200 mm and a relative density of 85% was produced by a CIP (cold isostatic pressing) process under conditions of a pressing force of 4,000 kg/cm$^2$ and a pressing period of 1 minute.

(e) The powder compact was heated in an Ar gas atmosphere to 500° C. and subjected to a hot extrusion under a condition of an extrusion ratio of 10 or more to provide a rounded rod-like sinter having a diameter of 50 mm and length of 1,800 mm.

(f) The sinter was subjected to a cutting in a direction perpendicular to an extruding direction to produce a disk-like blank which was then subjected to a machining to provide a ring-like blank having a ring joint 51 (FIG. 9).

(g) The ring-like blank was subjected to a finishing such as a polishing to provide a fiber-reinforced piston ring.

Table VI illustrates a relationship between the volume fraction Vf of the SiC whiskers and tensile strength at 300° C. for piston rings $N_1$ to $N_4$ produced using the above-described matrix by the above-described procedure. In a piston ring Q, AA specification 6061 (an Al-Mg-Si based corrosion-resistant aluminum alloy) having a tensile strength at 300° C. of 8 kg/mm$^2$ is used as a matrix.

TABLE VI

| Piston ring | Volume fraction Vf of SiC whiskers Vf (%) | Tensile strengthe at 300° C. (kg/mm$^2$) |
|---|---|---|
| $N_1$ | 2 | 18 |
| $N_2$ | 3.5 | 21 |
| $N_3$ | 25 | 35 |
| $N_4$ | 30 | 37 |
| Q | 25 | 16 |

As apparent from Table VI, each of the piston rings $N_2$ and $N_3$ has a tensile strength of more than 20 kg/mm$^2$, because it is formed of the aluminum alloy matrix having a tensile stength at 300° C. of 10 kg/mm$^2$ and the SiC whiskers having a volume fracton of 3 to 25%.

In the piston ring $N_1$, no high-temperature strength improving effect is obtained because of its lower volume fraction of the Sic whiskers of 2%. The piston ring $N_4$ has a disadvantage that in producing the powder compact by utilizing a powder metallurgical process as described above, the moldability thereof is poor and the workability is also inferior, rsulting in an increased manufacture cost, because the piston ring $N_4$ has a high volume fraction of the SiC whiskers of 30%. Further, the piston ring Q has a lower tensile strength at a high temperature due to a shortage of the strength of the matrix.

FIG. 11 illustrates results of an actual durability test when the piston ring $N_2$ according to the present invention and the comparative piston ring are used as a top ring. This test was conducted by continuously operating the engine at a number of revolutions of 6,000 rpm for 100 hours and by determining the amount of gas blown-by (l/min.) during the subsequent operation of the engine. In this case, the intake pressure $P_B$ was of −500 mm Hg.

In FIG. 11, a line $e_1$ correspoonds to the results when the piston ring $N_2$ was used; a line $e_2$ corresponds to the results when a piston ring as a comparative example made of the aluminum alloy (AA specification A390 having a tensile strength at 300° C. of 11 kg/mm$^2$) was used; and a line $e_3$ corresponds to the results when a piston ring as a comparative example made of a steel was used.

It is apparent from the line $e_1$ that when the piston ring $N_2$ according to the present invention is used, the amount of gas blown-by is smaller even in a range of higher rotations of 6,000 rpm of the engine as in a range of lower rotations. This is attributable to the fact that the piston ring $N_2$ is light-weight and higher in high-temperature strength.

With the piston ring made of the steel indicated by the line $e_3$, the sealing property in a range of higher rotations of the engine is deteriorated due to the inertia force thereof, resulting in an increased amount of gas blown-by.

With the piston ring made of the aluminum alloy indicated by the line $e_2$, the amount of gas blown-by is increased as the number of revolutions of the engine increases, because of its lower high-temperature strength.

FIGS. 12A to 12C illustrate a behaviour of a piston ring $\mathbf{50_0}$ in a top ring groove 52 in a piston 4, FIG. 12A shows the piston ring in a compression stroke, and FIG. 12B shows the piston ring in an explosion stroke. Reference numeral 53 is an inner perihperal surface of a cylinder bore in a cylinder block 1.

In this way, the piston ring $\mathbf{50_0}$, in the compression stroke, assumes an attitude in which its center line $O_1$—$O_1$ has a predetermined inclination with respect to a center line $O_2$—$O_2$ of the cylinder bore and in the explosion stroke, assumes an attitude, upon a reception of an explosion pressure P, in which its center line $O_1$—$O_1$ substantially conforms with the center line $O_2$—$O_2$ of the cylinder bore.

The piston ring $\mathbf{50_0}$ has a pair of end faces **50*a* and 50*b* opposed respectively to inner opposed surfaces 52*a* and 52*b* of the top groove 52 and hence, one 50*b* of the end faces 50*a* and 50*b* closer to a crank case is strongly mated with one of the inner opposed surfaces 52*b*. Such end face 52*b* tends to be worn in a struck manner as shown in FIG. 12C by repeating of such mating, thereby providing a recess 54**.

A piston ring $\mathbf{50_1}$ according to the present invention is made using a disk-like blank produced by application of a hot extrusion and by cutting in a direction perpendicular to an extruding direction in the course of production of the piston ring. Therefore, as shown in FIG. 13, an aluminum alloy powder is extended in the extruding direction with the metal flow pattern in the extruding direction, and by presence of the SiC whiskers in a grain boundary, an infinite number of fiber groups f1 of the SiC whiskers each in a generally very small circle are distributed over the end faces **50*a* and 50*b* opposed to the inner opposed surfaces 52*a* and 52*b* of the top ring groove 52, and an infinite number of fiber groups f2 of the SiC whiskers each in a generally very small oval with its lengthwise axis turned in a direction of the center line $O_2$—$O_2$ of the cylinder bore are distributed over a sliding surface 50*c* in slide contact with an inner peripheral surface 53** of the cylinder bore.

Therefore, the fiber concentration is higher in the end faces 50a and 50b and thus, the aforesaid struck wearing is prevented. On the other hand, the fiber concentration in the sliding surface 50c is lower than that in the end faces 50a and 50b and thus, wearing of the inner peripheral surface 53 of the cylinder bore will be suppressed. In addition, the wear resistance of the slide surface 50c is also improved by insuring a given fiber concentration.

In this case, if only the end face 50b which is closer to the crank case and which is worn in the struck manner has a high fiber concentration, an intended purpose can be attained.

In the process of making the piston ring $\mathbf{50_1}$, the ring-shaped blank may be subjected to a hot forging at a heating temperature of 450° C. in some cases after the step (f). This forging provides a tendency to vary the fiber concentrations of the opposite end faces 50a and 50b and the slide surface 50c so that the fiber concentration of the opposite end faces 50a and 50b may be higher than that of the slide surface 50c in the resulting piston ring $\mathbf{50_1}$. In this case, only that one 50b of the opposite end faces 50a and 50b which is closer to the crank case may be higher in fiber concentration.

It is desirable that the maximum diameter of the precipitates and crystallizates in the aluminum alloy matrix is of 50 μm or less. Any maximum diameter exceeding 50 μm will result in a reduced strength of the resulting piston ring and a prevented uniformalization of the quality.

In order to provide an improvement in sliding characteristic, at least one selected from carbon, BN and $MoS_2$ particles may be contained as a solid lubricant in the piston ring in an amount of 0.5% or more and 10% or less by weight. In this case, if the content of solid lubricant is less than 0.5% by volume, the lubricating effect is smaller. On the other hand, if the content is more than 10% by volume, the resulting piston ring has a reduced strength.

EXAMPLE VI

A piston ring for an internal combustion engine shown in FIGS. 14 and 15 is formed from a quenched and solidified aluminum alloy. Such an aluminum alloy contains 5% or more and 30% or less by weight of at least one selected from the group consisting of Cr, Fe, Mn, Zr, Ti and Ni.

Table VII illustrates compositions of aluminum alloys $A_{11}$ to $A_{20}$ used in the present invention and aluminum alloys $B_7$ to $B_9$ as comparative examples.

TABLE VII

| Alloy | Chemical constituents (% by weight) | | | | | | |
|---|---|---|---|---|---|---|---|
| | Cr | Fe | Mn | Zr | Ti | Ni | Al |
| $A_{11}$ | 5 | — | 2 | 2 | 1 | — | Balance |
| $A_{12}$ | 8 | — | 2 | 2 | 1 | — | Balance |
| $A_{13}$ | 11 | 0.5 | 1 | 1 | 0.5 | 1 | Balance |
| $A_{14}$ | 11 | 1 | — | 1 | — | — | Balance |
| $A_{15}$ | 11 | 3 | — | — | 2 | — | Balance |
| $A_{16}$ | 8 | 3 | 2 | — | — | — | Balance |
| $A_{17}$ | 15 | — | 2 | 2 | 1 | — | Balance |
| $A_{18}$ | 8 | — | 6 | — | 1 | — | Balance |
| $A_{19}$ | 8 | 1 | — | 6 | 1 | — | Balance |
| $A_{20}$ | 5 | — | 2 | 2 | — | — | Balance |
| $B_7$ | 3 | 1 | — | — | — | — | Balance |
| $B_8$ | 8 | — | 2 | 2 | 1 | — | Balance |
| $B_9$ | 2 | — | 1 | 1 | — | 0.5 | Balance |

Table VIII illustrates a relationship between the average diameter of precipitates and crystallizates and the tensile strength at 300° C. for the alloys $A_{11}$ to $A_{20}$ and $B_7$ to $B_9$. Table IX illustrates a relationship between the average diameter of precipitates and crystallizates and the tensile strength at 300° C. for the alloys $A_{11}$ and $A_{16}$.

TABLE VIII

| Alloy | Average diameter of Pre. and Cry. (μm) | Tensile strength at 300° C. ($kg/mm^2$) |
|---|---|---|
| $A_{11}$ | 2 to 5 | 26 |
| $A_{12}$ | 2 to 5 | 36 |
| $A_{13}$ | 2 to 5 | 38 |
| $A_{14}$ | 2 to 5 | 35 |
| $A_{15}$ | 2 to 5 | 30 |
| $A_{16}$ | 2 to 5 | 36 |
| $A_{17}$ | 2 to 5 | 36 |
| $A_{18}$ | 2 to 5 | 30 |
| $A_{19}$ | 2 to 5 | 31 |
| $A_{20}$ | 2 to 5 | 24 |
| $B_7$ | 2 to 5 | 19 |
| $B_8$ | 20 to 500 | 12 |
| $B_9$ | 2 to 5 | 12 |

Pre. = precipitates
Cry. = crystallizates

TABLE IX

| Alloy | Average diameter of Pre. and Cry. (μm) | Tensile strength of 300° C. (kg/mm2) |
|---|---|---|
| $A_{11}$ | 2 | 26 |
| | 5 | 23 |
| | 9 | 20 |
| | 10.5 | 18 |
| | 50 | 14 |
| $A_{16}$ | 2 | 32 |
| | 9.5 | 23 |
| | 12 | 19 |
| | 50 | 17 |

As apparent from Tables VII to IX, if the total content of the chemical constituents is in a range of 5% (inclusive) to 30% by weight (inclusive) and the average diameter of the precipitates and crystallizates is of 10 μm or less, it is possible to assure a tensile strength of 20 $kg/mm^2$ or more at 300° C.

Description will now be made of an example of the production of a piston ring using a quenched and solidified aluminum alloy of the same type as described above, i.e., an aluminum alloy comprising 6% by weight of Cr, 3% by weight of Fe, 2% by weight of Zr and the balance of Al.

(a) Using a molten metal having the above alloy composition, a quenched and solidified aluminum alloy powder was prepared by utilizing a gas atomizing process under a condition of a cooling rate of $10^2$ to $10^6$ ° C./sec.

(b) The alloy powder was subjected to a classifying treatment to provide an alloy powder having an average particle size of 20 μm.

(c) Using the alloy powder, a powder compact having a diameter of 160 mm, a length of 200 mm and a relative density of 85% was produced by application of a CIP (cold isostatic pressing) process under conditions of a pressing force of 4,000 $kg/cm^2$ and a pressing period of 1 minute.

(d) The powder compact was heated in an Ar gas atmosphere to 450° C. and subjected to a hot extrusion under a condition of an extrusion ratio of 10 or more to provide a rounded rod-like sinter having a diameter of 50 mm and a length of 1,800 mm. The metal flow line in this sinter is in an extruding direction and thus in an axial direction.

(e) The sinter was subjected to a cutting in a direction perpendicular to an axis of the sinter, and the cutout disk-like blank was subjected to a machining to provide a ring-shaped blank having a fitting opening 51 (FIG. 14).

(f) The ring-shaped blank was subjected to a hot forging at a heating temperature of 450° C.

(g) The ring-shaped blank was subjected to a finishing such as polishing to provide a piston ring $50_2$.

The average diameter of precipitates and crystallizates in this piston ring was of 2.0 μm, and the tensile strength thereof was of 30 kg/cm$^2$ at 300° C.

Table X illustrates results of an actual durability test using the above piston ring according to the present invention and piston rings as comparative examples. This test was carried out by continuously operating an engine at a number of revolutions of 6,000 rpm for 100 hours and by determining the amount of gas blown-by (l/min) during the subsequent operation of the engine.

TABLE X

| | Material of P.R. | T.S. (kg/mm$^2$) | Amount (l/min) |
|---|---|---|---|
| P.I. | Al—Cr—Fe—Zr based alloy | 30 | 21 |
| C.E. | Cast iron | 23 | 15 |
| | Al alloy (JIS AC8A) | 8 | 120 |
| | Al alloy (A390) | 11 | 220 |

P.R. = Piston ring
T.S. = Tensile strength at 300° C.
Amount = Amount of gas blown-by
P.I. = Present invention
C.E. = Comparative example In Table X, the AC8A material used is Lo-Ex, and A390 is an AA specification Al-Si based alloy.

As apparent from Table X, the piston ring according to the present invention has a high-temperature strength equal to that of the piston ring made of cast iron and a blown-by gas amount suppressing effect, and moreover, is lighter in weight than that of the cast iron piston ring.

Other than the aluminum alloy containing at least one selected from only the group of chemical constituents: Cr, Fe, Mn, Zr, Ti and Ni as in the previous embodiment, an aluminum alloy in another embodiment which may be used in the present invention may contain the same range of 5% or more and 30% or less by weight of at least one chemical constituent selected from the group consisting of Cr, Fe, Mn, Zr, Ti, Ni, V, Ce, Mo, La, Nb, Y, Hf and Co.

The volume fraction of precipitates and crystallizates in these aluminum alloys may be set at 60% or less. The reason is that any volume fraction exceeding 60% will cause disadvantages of a reduction in elongation, a degradation in workability and an increase in notch sensitivity, attendant with a reduction in durability and the like.

It should be noted that groups of micro-pieces $s_1$ and $s_2$, as seen in the valve stem 21 of FIG. 4A, are observed in the piston ring $50_2$. In this case, the groups of micro-pieces have the same effect as the fiber groups $f_1$ and $f_2$ do in the piston ring $50_1$ of FIG. 13.

What is claimed is:

1. A heat resistant slide member for an internal combustion engine, which is a plastically worked member formed from a quenched and solidified aluminum alloy containing at least one selected from the group consisting of Cr, Fe, Zr and Ti in an amount of 5% or more and 30% or less by weight and having an average diameter of precipitates and crystallizates therein of 50 μm or less and a tensile strength at 300° C. of 18 kg/mm$^2$ or more, wherein a metal flow line in a sliding portion of the worked member is set in a sliding direction thereof.

2. A heat resistant slide member for an internal combustion engine according to claim 1, wherein said slide member is a piston ring, and wherein the average diameter of said precipitates and crystallizates is set at 10 μm or less, and said tensile strength is set at 20 kg/mm$^2$ or more.

3. A heat resistant slide member for an internal combustion engine according to claim 1, wherein the volume fraction of said precipitates and crystallizates is of 60% or less.

4. A heat resistant slide member for an internal combustion engine, which is a plastically worked member formed from a quenched and solidified aluminum alloy containing at least one selected from the group consisting of Cr, Fe, Zr, Ti, Mn, Ni, V, Ce, Mo, La, Nb, Y, Hf and Co in an amount of 5% or more and 30% or less by weight and having an average diameter of precipitates and crystallizates therein of 50 μm or less and further having a tensile strength at 300° C. of 18 kg/mm$^2$ or more, wherein a metal flow line in a sliding portion of the worked member is set in a sliding direction thereof.

5. A heat resistant slide member for an internal combustion engine according to claim 4, wherein said slide member is a piston ring, and wherein the average diameter of said precipitates and crystallizates is set at 10 μm or less, and said tensile strength is set at 20 kg/mm$^2$ or more.

6. A heat resistant slide member for an internal combustion engine according to claim 4 or 5, wherein the volume fraction of said precipitates and crystallizates is of 60% or less.

7. A heat resistant slide member for an internal combustion engine according to claim 1, wherein said quenched and solidified aluminum alloy consists of Cr, Fe and Zr in amounts of $4 \leqq Cr \leqq 10\%$ by weight, $0.5 \leqq Fe \leqq 4\%$ by weight and $0.5 \leqq Zr \leqq 3\%$ by weight and the balance of Al including unavoidable impurities.

8. A heat resistant slide member for an internal combustion engine according to claim 7, wherein the maximum diameter of the precipitates and crystallizates in said quenched and solidified aluminum alloy is of 10 μm or less.

9. A heat resistant slide member for an internal combustion engine according to claim 8, wherein said slide member includes a first region having a larger Cr content and extending over the entire high-temperature exposed portion requiring a heat resistance and over a connected portion of the sliding portion connected to said high-temperature exposed portion, and a second region having a smaller Cr content than that of said first region and extending over the entire remaining portion of said sliding portion.

10. A heat resistant slide member for an internal combustion engine according to claim 9, wherein the Cr content in said first region is set at $6 \leqq Cr \leqq 10\%$ by weight, and the Cr content in said second region is set at $4 \leqq Cr < 6\%$ by weight.

11. A heat resistant slide member for an internal combustion engine according to claim 10, wherein a central portion of said connected portion is included in said first region, and an outer layer portion surrounding said central portion is included in said second region.

12. A heat resistant slide member for an internal combustion engine according to claim 11, wherein the metal flow line in said high-temperature exposed portion is in a direction perpendicular to the sliding direction, and the metal flow line in said sliding portion is in the sliding direction.

13. A heat resistant slide member for an internal combustion engine according to claim 12, wherein a hard layer is formed on at least one surface selected from an abutment surface of said high-temperature exposed portion, a sliding surface of said sliding portion and end faces of said sliding portion.

14. A heat resistant slide member for an internal combustion engine according to claim 7, 8, 9, 10, 11, 12 or 13, wherein said slide member is an intake valve including a valve head which is the high-temperature exposed portion, and a valve stem which is the sliding portion.

15. A heat resistant slide member for an internal combustion engine according to claim 7, wherein said slide member includes a high-temperature exposed portion requiring a heat resistance, and the sliding portion connected to said high-temperature exposed portion, and wherein the average diameter of the precipitates and crystallizates in said quenched and solidified aluminum alloy forming said high-temperature exposed portion is of 5 μm or less, and the average diameter of the precipitates and crystallizates in said quenched and solidified aluminum alloy forming said sliding portion is of 5 μm or more and 50 μm or less.

16. A heat resistant slide member for an internal combustion engine according to claim 15, wherein said slide member is an intake valve including a valve head which is the high-temperature exposed portion and a valve stem which is the sliding portion.

17. A heat resistant slide member for an internal combustion engine according to claim 7, wherein said slide member includes a high-temperature exposed portion requiring a heat resistance, and a sliding portion connected to said high-temperature exposed portion, said high-temperature exposed portion and said sliding portion being formed of said quenched and solidified aluminum alloy matrix and a reinforcing fiber, the average aspect ratio of the reinforcing fiber present in said high-temperature exposed portion being set at a larger level, and the average aspect ratio of the reinforcing fiber present in said sliding portion being set a smaller level than that of the reinforcing fiber present in said high-temperature exposed portion.

18. A heat resistant slide member for an internal combustion engine according to claim 17, wherein the average aspect ratio of the reinforcing fiber present in said high-temperature exposed portion is of 50 or less, and the average aspect ratio of the reinforcing fiber present in said sliding portion is of 15 or less.

19. A heat resistant slide member for an internal combustion engine according to claim 18, wherein the average orientation angle of the reinforcing fiber present in said sliding portion is set at ±30° or less with respect to an axis of said slide member.

20. A heat resistant slide member for an internal combustion engine according to claim 18, wherein the average orientation angle of the reinforcing fiber present in said high-temperature exposed portion is set at ±60° or less with respect to an axis of said slide member.

21. A heat resistant slide member for an internal combustion engine according to claim 18, wherein the reinforcing fiber present in said high-temperature exposed portion is orientated at random.

22. A heat resistant slide member for an internal combustion engine according to claim 17, 18, 19, 20 or 21, wherein said slide member is an intake valve including a valve head which is the high-temperature exposed portion, and a valve stem which is the sliding portion.

23. A heat resistant slide member for an internal combustion engine, which is formed of an aluminum alloy matrix having a tensile strength at 300° C. of 10 $kg/mm^2$ or more, and a ceramic fiber having a volume fraction of 3% or more and 25% or less, and which has a tensile strength at 300° C. of 20 $kg/mm^2$ or more.

24. A heat resistant slide member for an internal combustion engine according to claim 23, wherein the maximum diameter of precipitates and crystallizates in said aluminum alloy matrix is of 50 μm or less.

25. A heat resistant slide member for an internal combustion engine according to claim 24, further including 0.5% or more and 10% or less by volume of at least one selected from carbon, BN and $MoS_2$ grains as a solid lubricant.

26. A heat resistant slide member for an internal combustion engine according to claim 25, wherein an infinite number of ceramic fiber groups each formed into a generally very small circle are distributed over an end face of the slide member, and an infinite number of ceramic fiber groups each formed into a generally very small oval and having a lengthwise axis directed in a sliding direction are distributed over a sliding surface of the slide member.

27. A heat resistant slide member for an internal combustion engine according to claim 26, wherein said end face and said sliding surface have different fiber concentrations.

28. A heat resistant slide member for an internal combustion engine according to claim 23, 24, 25, 26 or 27, wherein said slide member is a piston ring.

* * * * *